US008389845B2

(12) United States Patent
Kunimoto et al.

(10) Patent No.: US 8,389,845 B2
(45) Date of Patent: Mar. 5, 2013

(54) APPARATUS FOR GENERATING MUSICAL TONE SIGNALS BASED ON MIXING DIFFERENT DECAY WAVEFORM DATA

(75) Inventors: Toshifumi Kunimoto, Hamamatsu (JP); Kiyoshi Hagino, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 505 days.

(21) Appl. No.: 12/725,286

(22) Filed: Mar. 16, 2010

(65) Prior Publication Data

US 2011/0094368 A1 Apr. 28, 2011

(30) Foreign Application Priority Data

Mar. 17, 2009 (JP) ..... 2009-063942

(51) Int. Cl.
*G10H 1/08* (2006.01)
*G10H 1/02* (2006.01)

(52) U.S. Cl. ..... 84/605; 84/609; 84/625; 84/626; 84/627

(58) Field of Classification Search ..... 84/605
See application file for complete search history.

(56) References Cited

U.S. PATENT DOCUMENTS 4,082,027 A * 4/1978 Hiyoshi et al. ..... 84/605
5,519,167 A * 5/1996 Kunimoto et al. ..... 84/661
2006/0045283 A1* 3/2006 Lin et al. ..... 381/63

FOREIGN PATENT DOCUMENTS

JP 3-5758 B2 3/1984

* cited by examiner

*Primary Examiner* — Christopher Uhlir
(74) *Attorney, Agent, or Firm* — Morrison & Foerster LLP

(57) ABSTRACT

A waveform memory WM stores fast decay waveform data representative of fast decay waveforms of different levels of strength and slow decay waveform data representative of a slow decay waveform of a strong strength. A CPU 21 controls a tone generator 15 to select at least a waveform data according to the level of strength of a touch from among the plurality of fast decay waveform data to read out the selected waveform data from the top address of the waveform data. In addition, the CPU 21 also controls the tone generator 15 to read out the slow decay waveform data, starting at an address placed further away from the top of the slow decay waveform data as the level of strength of the touch decreases. The read fast decay waveform data and the read slow decay waveform data is mixed together to be output.

6 Claims, 16 Drawing Sheets right after start of generation of tone frequency after stable point
(after lapse of certain time period following start of generation of tone)

frequency original waveforms fast decay component waveforms slow decay component waveforms fast decay waveform data slow decay waveform data peak tracks of original waveform peak tracks of slow decay component waveform

APPARATUS FOR GENERATING MUSICAL TONE SIGNALS BASED ON MIXING DIFFERENT DECAY WAVEFORM DATA

BACKGROUND OF THE INVENTION

1. Field of the Invention

The present invention relates to a musical tone signal generating apparatus which previously stores waveform data representative of waveforms of musical tones in a memory to read out, in response to a demand for starting generation of a musical tone, the waveform data from the memory to generate a musical tone signal.

2. Description of the Related Art

Conventionally, as disclosed in Japanese Examined Patent Publication No. 3-5758, for example, a musical tone signal generating apparatus has been known which stores waveform data representative of waveforms of decay-type musical tones in a memory in a manner in which respective key tone pitches are correlated with the waveforms to read out, in response to depressions of keys, waveform data corresponding to the depressed keys with the passage of time to generate musical tone signals. The conventional musical tone signal generating apparatus is designed such that the read-out starting position of waveform data varies depending on the level of strength of a key touch. More specifically, a strong key touch results in starting reading out waveform data from the top whereas the read-out starting position of waveform data moves backward as the strength of a key touch decreases. As a result, the conventional musical tone signal generating apparatus enables generation of musical tone signals having amplitudes corresponding to respective levels of strength of key touches. The above-described patent publication also discloses that the invention of the patent publication can be also applied to generation of musical tones of percussion instruments by storing waveform data representative of waveforms of percussion musical tones in the memory to change the read-out starting position of the waveform data depending on the level of strength of striking of the percussion instruments to generate a musical tone signal according to the level of strength of the striking as in the above-described case.

SUMMARY OF THE INVENTION

As for decay-type musical tones having various tone pitches and musical tones of percussion instruments, in general, variations in the strength of played musical tones (the level of strength of key touch or level of intensity of strike) lead to subtle variations in musical tone waveforms which vary with time. According to the above-described conventional art, however, even for musical tones having different levels of strength, the musical tones are generated in accordance with the same waveform data simply by changing the read-out starting position. Therefore, the conventional art fails to generate realistic musical tone signals in accordance with the level of strength of musical tones to be generated. In order to resolve the failing, a plurality of waveform data sets representative of a plurality of waveforms of musical tones having different strengths have to be stored in the memory to switch the waveform data sets according to the level of strength of a musical tone to be generated. However, the need for preparing the plurality of waveform data sets of different strengths requires an increase in the amount of waveform data, resulting in a problem that a large capacity memory is needed. As for musical tones having a multiplicity of tone pitches which form a scale, particularly, it is necessary to prepare waveform data sets for each tone pitch or for each certain tone range, resulting in vast amounts of waveform data.

Considering the above-described problem, the inventors of the present invention have discovered the following through various experiments. As indicated in FIG. 6A, a waveform of a decay-type musical tone right after the start of generation thereof includes not only fundamental wave components and harmonic components but also frequency components other than them and noise components (non-harmonic components), so that the waveform itself fluctuates with time without being stable. However, after a lapse of time following the start of generation of the musical tone, that is, after a stable point, as indicated in FIG. 6B, the waveform of the decay-type musical tone is formed mainly of fundamental wave components and harmonic components to be stable. Based on these findings, the inventors of the present invention have found that, as indicated in FIG. 7, when waveforms of decay-type musical tones are separated into component waveforms which decay fast (fast decay component waveforms) and component waveforms which decay slowly (slow decay component waveforms), the fast decay component waveforms vary depending on the strength of musical tones to be generated whereas the slow decay component waveforms rarely vary in spite of variations in the strength of musical tones to be generated. FIG. 7A simulates original waveforms of musical tones as a whole. FIG. 7B simulates fast decay component waveforms, while FIG. 7C simulates slow decay component waveforms. The inventors' experiments have discovered that the waveforms of musical tones of electric pianos, tom-toms, timpani and the like strongly show this tendency.

The present invention was accomplished to solve the above-described problem, and an object thereof is to provide a musical tone signal generating apparatus which reduces the amount of waveform data and generates realistic musical tone signals regardless of variations in the strength of musical tones to be generated.

In order to achieve the above-described object, it is a feature of the present invention to provide a musical tone signal generating apparatus comprising a waveform memory (WM) storing fast decay waveform data of a plurality of fast decay waveforms, extracted from a plurality of waveforms of a musical instrument performed with various levels of strength, and slow decay waveform data of a slow decay waveform, extracted from a waveform of the musical instrument performed with a high level of strength; a first read-out section (15*a*, S18, S18*a*, S20, S20*a*, S26, S26*a*) for selecting, in response to a generation start command which instructs the apparatus to newly generate a musical tone signal and includes strength information representative of level of strength of the musical tone signal, fast decay waveform data of at least a fast decay waveform from among the fast decay waveform data stored in the waveform memory, according to the strength information, and reading out the selected fast decay waveform data from the top address of the selected fast decay waveform data; a second read-out section (15*a*, S22, S24, S24*a*, S26, S26*a*) for determining, in response to the generation start command, a read start address of the slow decay waveform data based on the strength information in the generation start command and reading out the slow decay waveform data stored in the waveform memory from the determined start address of the slow decay waveform data, the read start address being determined further away from the top address of the slow decay waveform data as the strength represented by the strength information decreases; and a mixing section (15*c*, 15*d*) for mixing the fast decay waveform data read out by the first read-out section and the slow decay waveform data read out by the second read-out section, and outputting the mixed waveform data.

According to the present invention configured as described above, the waveform memory stores fast decay waveform data of a plurality of fast decay waveforms, extracted from a plurality of waveforms of a musical instrument performed with various levels of strength, and slow decay waveform data of a slow decay waveform, extracted from a waveform of the musical instrument performed with a high level of strength. The first read-out section selects, from among the fast decay waveform data stored in the waveform memory, fast decay waveform data of at least a fast decay waveform data and then reads out the selected fast decay waveform data. The second read-out section reads out the slow decay waveform data stored in the waveform memory. Then, the mixing section mixes the fast decay waveform data read out by the first read-out section and the slow decay waveform data read out by the second read-out section and then outputs the resultant data. As described above, the fast decay waveforms vary depending on the level of strength of each generated musical tone, whereas the slow decay waveforms rarely vary regardless of the level of strength of each generated musical tone. Therefore, the resultant mixed waveform data represents, with high accuracy, a musical tone waveform which can vary depending on the level of strength. As a result, the musical tone generating apparatus of the present invention generates realistic musical tone signals. In addition, because the fast decay waveform data represents fast decay waveforms each requiring a short period of time from the start to the end of generation thereof, the amount of data of each fast decay waveform data is not that large. Although the slow decay waveform data represents a slow decay waveform which takes a long period of time from the start to the end of generation, only one slow decay waveform data is stored in the waveform memory. Therefore, the musical tone signal generating apparatus of the present invention reduces the amount of waveform data necessary for generation of musical tone signals, also eliminating the need for a waveform memory of a large capacity.

Furthermore, the second read-out section reads out the slow decay waveform data stored in the waveform memory in accordance with the passage of time, with a read-out start address of the slow decay waveform data being determined such that as the level of strength of the musical tone signal represented by the strength information decreases, the read-out start address is placed further away from the top address of the waveform data. As the strength of a musical tone signal to be generated decreases, therefore, the time taken from the start to the end of the reading of the waveform data shortens to shorten the time taken from the start to the end of generation of the musical tone signal. Such a characteristic coincides with a characteristic of decay-type musical tones of musical instruments that as the strength of a generated musical tone decreases, the time taken from the start to the end of generation of the musical tone shortens. As a result, the present invention is able to more favorably imitate decay-type musical tones by the simple scheme of changing the read-out start address depending on the strength information.

It is another feature of the present invention to configure the first read-out section and the mixing section as follows. The first read-out section selects, in response to the generation start command, fast decay waveform data of a first fast decay waveform and a second fast decay waveform, having two adjacent strengths between which the strength represented by the strength information falls into, from among the fast decay waveform data stored in the waveform memory, and reads out fast decay waveform data of the first fast decay waveform and fast decay waveform data of the second fast decay waveform in parallel from their respective top addresses (15*a*, S18*a*, S20*a*, S26*a*). The mixing section has a designating section (S30) for designating, in accordance with the strength information and the two adjacent strengths, a mixing ratio. And the mixing section controls tone volume of the fast decay waveform data of the first fast decay waveform and tone volume of the fast decay waveform data of the second fast decay waveform, according to the designated mixing ratio, and then mixes the fast waveform data of the first fast decay waveform, the fast decay waveform data of the second fast waveform and the slow decay waveform data read by the second read-out section to output the mixed waveform data (15*c*, 15*d*).

According to the another feature of the present invention configured as described above, the first read-out section selects waveform data of two different levels of strength which sandwich the strength of the musical tone signal represented by the strength information and reads out the waveform data. The mixing section mixes the read waveform data of the two different levels of strength in a mixing ratio designated in accordance with the strength of the musical tone signal represented by the strength information and the two different levels of strength. As a result, the fast decay waveform data which is to be mixed with the slow decay waveform data is obtained by interpolating (cross-fading), in accordance with the strength of the musical tone signal represented by the strength information and the two levels of strength which sandwich the strength of the musical tone signal, the waveform data of the two levels of strength which sandwich the strength. Even if the number of waveform data corresponding to different levels of strength stored as the fast decay waveform data in the waveform memory is reduced, therefore, the musical tone signal generating apparatus according to the another feature is able to output, with high accuracy, a fast decay waveform corresponding to the strength of the musical tone signal represented by strength information.

It is a further feature of the present invention that the mixing section controls tone volume of the fast decay waveform data read by the first read-out section in accordance with the strength information, such that the tone volume of the fast decay waveform data increases as the strength represented by the strength information increases, before mixing the fast decay waveform data with the slow decay waveform data read by the second read-out section (15*c*, 15*d*).

According to the further feature of the present invention configured as described above, even in a case of fast decay waveform data of a musical tone signal having a low level of strength, the fast decay waveform data can be stored in the waveform memory with a high amplitude level to enable reproduction of the fast decay waveform data of the low level of strength with high accuracy.

DESCRIPTION OF THE PREFERRED EMBODIMENT a. Embodiment of Invention

Figure 1:
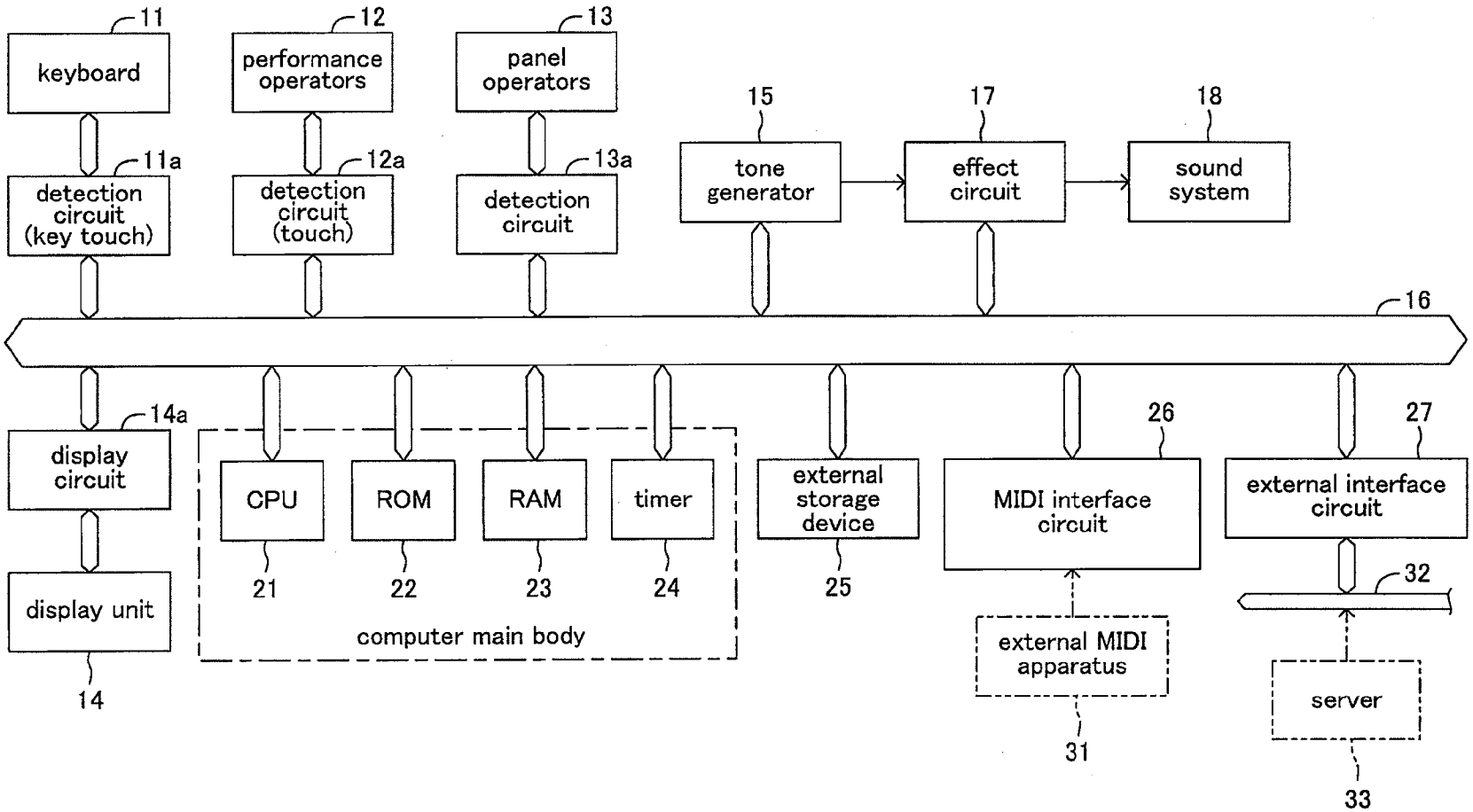
FIG. 1 is a general block diagram indicating an electronic musical instrument to which the musical tone signal generating apparatus according to an embodiment of the present invention is applied.

An embodiment of the present invention will now be described with reference to the drawings. FIG. 1 is a general block diagram indicating an electronic musical instrument to which the musical tone signal generating apparatus according to the embodiment of the present invention is applied. The electronic musical instrument has a keyboard 11, a plurality of performance operators 12, a plurality of panel operators 13, a display unit 14 and a tone generator 15.

The keyboard 11, which is manipulated by a player, is formed of a plurality of white keys and a plurality of black keys each provided in order to specify a tone pitch of a musical tone to be generated and demand to generate the musical tone. The keyboard 11 also has a key touch sensing mechanism for sensing key touch strength VEL such as velocity and pressure of a depression of a key. The depression/release and the key touch strength VEL of each key of the keyboard 11 are detected by a detection circuit 11*a* connected to a bus 16. The detection circuit 11*a* outputs a key-on signal KON and a key-off signal KOF indicative of a depression/release of a key, a note number NN indicative of the depressed/released key and a key touch signal indicative of the key touch strength VEL to the bus 16. The plurality of performance operators 12 are switches corresponding to various kinds of percussion instruments, respectively. The performance operators 12 are manipulated by the player in order to demand to generate percussion tones. The performance operators 12 are also provided with an operator touch sensing mechanism for sensing operator touch strength VEL such as velocity and pressure of a depression of a switch. The depression and the operator touch strength VEL of each performance operator 12 are detected by a detection circuit 12*a* connected to the bus 16. The detection circuit 12*a* outputs a switch-on signal SWON indicative of a depression of the performance operator 12, an instrument type information IN indicative of the type of percussion instrument corresponding to the depressed performance operator 12 and an operator touch signal indicative of the operator touch strength VEL to the bus 16.

The plurality of panel operators 13, which are formed of a plurality of switches, volumes and the like provided on an operating panel of the electronic musical instrument, are manipulated by the player to control various operations of the electronic musical instrument including a manner in which musical tone signals are generated. Each manipulation of the panel operators 13 is detected by a detection circuit 13*a* connected to the bus 16. The detection circuit 13*a* outputs a detected signal indicative of a manipulation of the panel operator 13 to the bus 16. The display unit 14, which is configured by a liquid crystal display, CRT or the like provided on the operating panel, displays characters, numerals, graphics and the like. To the display unit 14, a display circuit 14*a* connected with the bus 16 is connected. The display circuit 14*a* controls what is displayed on the display unit 14 in accordance with image data supplied through the bus 16.

Figure 2:
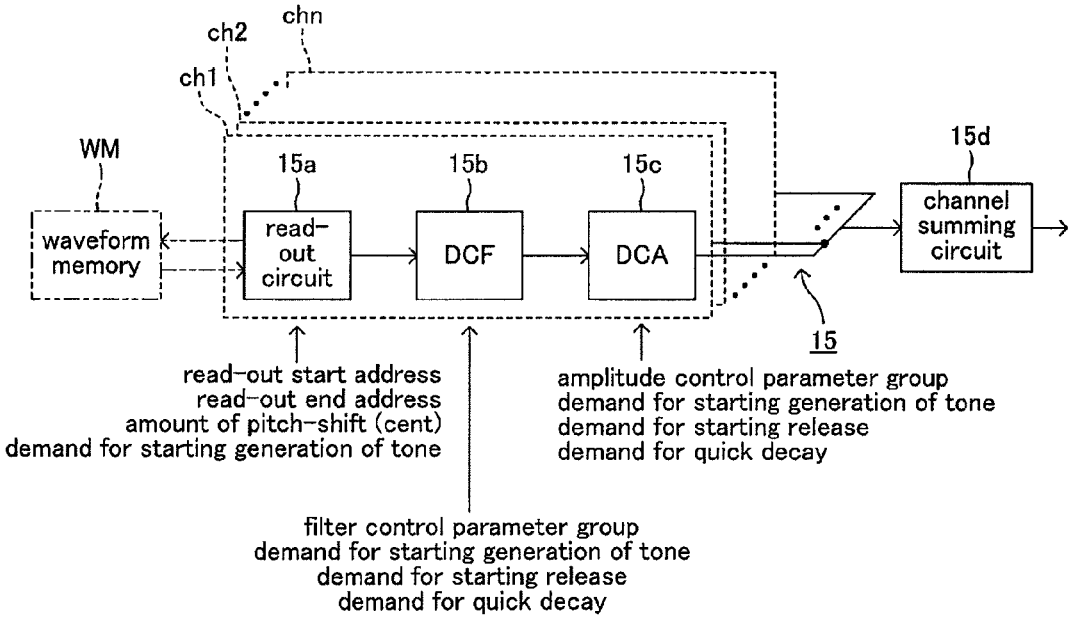
FIG. 2 is a block diagram indicating a concrete configuration of a tone generator indicated in FIG. 1.

The tone generator 15, which is connected to the bus 16, generates digital musical tone signals in accordance with various kinds of control signals supplied through the bus 16 and then outputs the generated digital musical tone signals to an effect circuit 17. As indicated in FIG. 2, the tone generator 15 is provided with a plurality of tone generation channels ch1, ch2 . . . chn. Each tone generation channel ch1, ch2 . . . chn, which is configured similarly, is provided with a read-out circuit 15*a*, a digital control filter 15*b* and a digital control amplifier 15*c* which perform processing necessary for generating digital musical tone signals in certain sampling periods. The read-out circuit 15*a* reads out waveform data stored in a later-described waveform memory WM in accordance with control parameters (read-out start address, read-out end address, amount of pitch-shift, etc.) and a demand for starting generation of a tone supplied from a later-described computer main body to generate a digital musical tone signal to output the generated digital musical tone signal to the digital control filter 15*b*. If necessary, in addition, the read-out circuit 15*a* interpolates the waveform data read out from the waveform memory WM. In a case where the waveform data stored in the waveform memory WM has been compressed, the read-out circuit 15*a* decompresses the compressed waveform data.

The digital control filter 15*b* controls frequency characteristic of the digital musical tone signal formed of the waveform data output from the read-out circuit 15*a* in accordance with control parameters (filter control parameter group, etc.), a demand for starting generation of a tone, a demand for starting release and a demand for quick decay supplied from the later-described computer main body to output the controlled digital musical tone signal to the digital control amplifier 15*c*. The digital control amplifier 15*c* controls amplitude characteristic (amplitude envelope) of the digital musical tone signal formed of the waveform data output from the digital control filter 15*b* in accordance with control parameters (amplitude control parameter group, etc.), a demand for starting generation of a tone, a demand for starting release, and a demand for quick decay supplied from the later-described computer main body to output the controlled digital musical tone signal to a channel summing circuit 15*d*. The channel summing circuit 15*d* sums digital musical tone signals supplied from the respective tone generation channels ch1, ch2 . . . chn. That is, the channel summing circuit 15*d* mixes the digital musical tone signals and then outputs the mixed signal.

The effect circuit 17 adds effects such as chorus and reverb to the digital musical tone signal output from the tone generator 15 in accordance with control parameters supplied from the later-described computer main body to output the digital musical tone signal to which the effects have been added to a sound system 18. The addition of the effects to the digital musical tone signal by the effect circuit 17 is done in each sampling period. The sound system 18, which includes a D/A converter, analog amplifiers and speakers, emits a musical tone corresponding to the digital musical tone signal supplied from the effect circuit 17.

The electronic musical instrument also has a CPU 21, a ROM 22, a RAM 23, a timer 24, an external storage device 25, a MIDI interface circuit 26 and an external interface circuit 27 which are connected to the bus 16, respectively. The CPU 21, the ROM 22, the RAM 23 and the timer 24 configures the computer main body. Particularly, the CPU 21 executes a note-on event process program indicated in FIG. 4. The external storage device 25, which includes a hard disk HD and a flash memory which have been previously incorporated into the electronic musical instrument, various kinds of storage media such as a compact disk CD and a flexible disk FD which are attachable to the electronic musical instrument and drive units for the storage media, can store and read various kinds of data and programs.

The ROM 22 or the external storage device 25 is provided with a later-described waveform memory WM which stores waveform data and a later-described tone color parameter memory PM which stores tone color control parameters. The ROM 22 or the external storage device 25 also stores various kinds of data including automatic performance data and automatic rhythm data and various kinds of programs including the note-on event process program. In this embodiment, the automatic performance data is the data storing, in a time-series manner in accordance with the progression of a song, key-performance event data on musical tones played with keys for the song (key-on and key-off events including key touch strength VEL) and percussion performance event data on musical tones played by percussion instruments (percussion manipulation events including operator touch strength VEL). The automatic rhythm data is the data storing, over a plurality of bars in accordance with the passage of time, percussion performance event data (percussion manipulation events including operator touch strength VEL) on percussion musical tones for each rhythm pattern type such as march and waltz. These data and programs may be previously stored in the ROM 22 or the external storage device 25. Alternatively, these data and programs may be externally retrieved via the MIDI interface circuit 26 or the external interface circuit 27. With the MIDI interface circuit 26, an external MIDI apparatus 31 such as another electronic musical instrument or a sequencer is allowed to be connected. The external interface circuit 27 is allowed to be connected to a server 33 via a communications network 32. The above-described various kinds of data and programs are thus retrieved by the electronic musical instrument from the external MIDI apparatus 31 or the server 33.

Figure 3A:
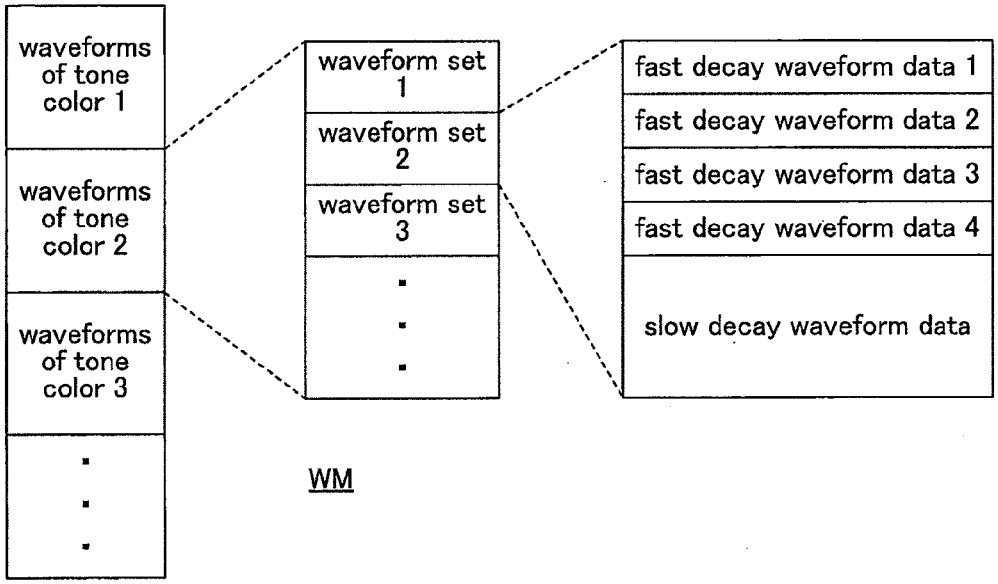
FIG. 3A is a memory map indicating the configuration of a waveform memory.

The waveform memory WM and the tone color parameter memory PM will now be described. As indicated in FIG. 3A, the waveform memory WM is divided into a plurality of storage areas corresponding to a plurality of tone colors, respectively. Although these tone colors include sustain-type musical tones, the present invention is not directly related to the sustain-type musical tones. Therefore, only the decay-type musical tones will be described. Each storage area corresponding to each tone color stores a plurality of waveform sets each formed of a waveform data group. The respective waveform sets of each storage area correspond to the respective keys (respective key tone pitches). Each waveform set is formed of sets of fast decay waveform data and a set of slow decay waveform data.

Figure 8A:
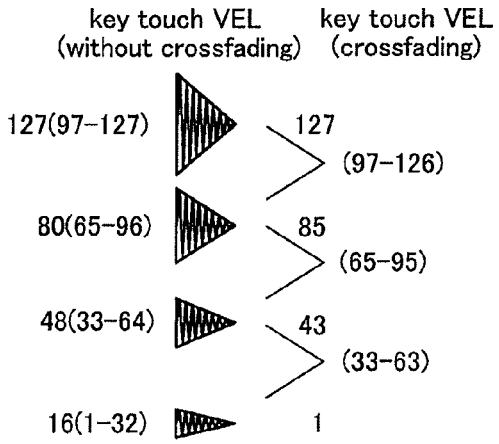
FIG. 8A is a schematic diagram indicating waveforms of a plurality of fast decay waveform data sets stored in the waveform memory.

Each fast decay waveform data set is the waveform data representative of a fast decay component waveform covering about one second. The fast decay waveform data set is obtained by extracting only the waveform of components which decay fast from a waveform of a decay-type musical tone. The fast decay waveform data sets included in a waveform set correspond to different levels of strength (key touch strength VEL) of a musical tone to be generated, respectively. In this embodiment, the sets of fast decay waveform data correspond to four different levels of strength, respectively. When the key touch strength VEL is represented as a value ranging from "1" to "127", for instance, each waveform set stores, as the sets of fast decay waveform data, four waveform data sets indicative of fast decay component waveforms extracted from played tones whose key touch strength VEL is "127", "80", "48" and "16", respectively, as indicated in the left side of FIG. 8A to start from top to bottom. The value "127" is the largest value of the entire range of "1" to "127" of the key touch strength VEL, while the values "80", "48" and "16" are respective approximate median values of the lower three areas obtained by roughly dividing the entire range of the key touch strength VEL into four areas. In this embodiment, the fast decay waveform data corresponding to the key touch strength "127" is employed because the employment of the same level of the key touch strength as the one employed by the following slow decay waveform data facilitates processing required for preparation of the waveform data. The value "127" may be replaced with a median value "112" of the highest area of the four-part split. Furthermore, the key touch strength VEL is not an absolute scale but a relative scale. Therefore, the values "80", "48", and "16" may also be replaced with other values. Although this embodiment employs the four levels of "127", "80", "48" and "16", the key touch strength VEL may be divided into three levels, five levels or more. The set of slow decay waveform data included in a waveform set is waveform data representative of a slow decay component waveform covering about ten seconds. The slow decay waveform data set is obtained by extracting a waveform of components which decay slow from a played tone which is played in the strongest strength. For instance, the slow decay waveform data is the waveform data indicative of a slow decay component waveform extracted from a played tone whose key touch strength VEL is "127".

The waveform memory WM also stores waveform data on percussion tones. Because only one waveform set is enough for the percussion tones without the need for providing a plurality of waveform sets for a plurality of keys (for respective key tone pitches), each storage area corresponding to each tone color stores only a waveform set. In this case as well as the above-described case, however, each waveform set includes, as sets of fast decay waveform data, four sets of waveform data indicative of fast decay component waveforms extracted from played tones (percussion tones) whose operator touch strength VEL is "127", "80", "48" and "16", respectively. In addition, the waveform set also includes a set of waveform data indicative of a slow decay component waveform extracted from a played tone (percussion tone) whose operator touch strength VEL is "127". In this case as well as the above-described case, the values of the operator touch strength VEL are not limited to "127", "80", "48" and "16" but may be replaced with other values. Methods for producing the fast decay waveform data and the slow decay waveform data on decay-type musical tones corresponding to a plurality of key tone pitches and percussion tones will be described in detail later. The fast decay waveform data and the slow decay waveform data may be stored in the waveform memory WM without any processing. Alternatively, the fast decay waveform data and the slow decay waveform data may be compressed before the storage. Although the respective amplitudes (levels of tone volume) of the fast decay waveform data sets corresponding to the different levels of key touch strength VEL (or operator touch strength VEL) stored in the waveform memory WM may correspond to the levels of key touch strength VEL (or operator touch strength VEL), this embodiment is designed such that the respective amplitudes of the fast decay waveform data sets are almost the same regardless of the different levels of key touch strength VEL (or operator touch strength VEL). This is because the waveform data can be stored with high accuracy by increasing the amplitude of the fast decay waveform data corresponding to the lower levels of key touch strength VEL (or operator touch strength VEL).

Figure 3B:
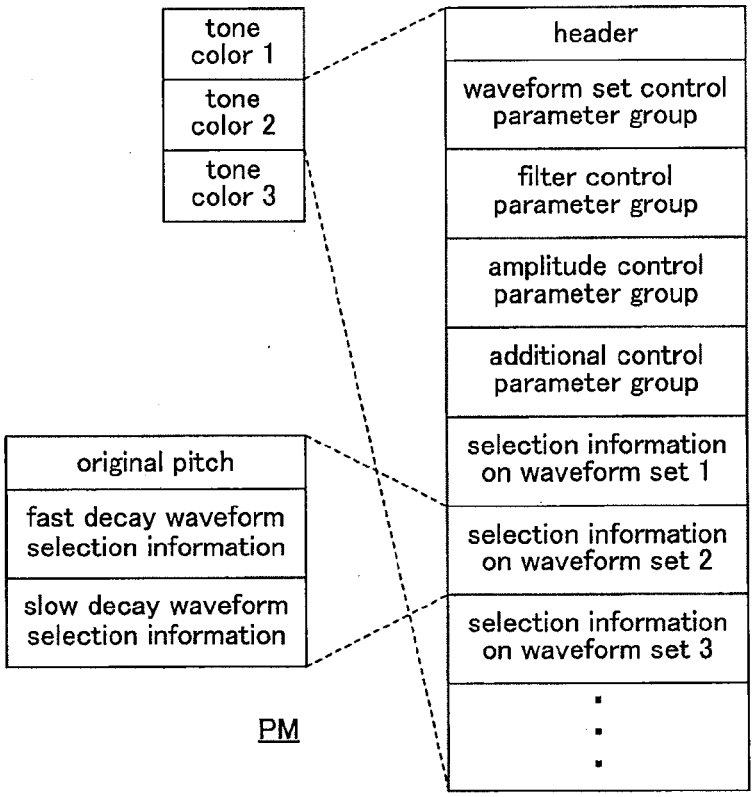
FIG. 3B is a memory map indicating the configuration of a tone color parameter memory.

As indicated in FIG. 3B, the tone color parameter memory PM is also divided into a plurality of storage areas corresponding to the tone colors, respectively. In this case as well, the present invention is not directly related to sustain-type musical tones. Therefore, only the decay-type musical tones will be described. A storage area corresponding to a tone color stores a header including tone color name information indicative of the name of the tone color, a waveform set control parameter group, a filter control parameter group, an amplitude control parameter group, an additional control parameter group, and selection information on a plurality of waveform sets, with the header being placed on the top of the storage area. The waveform set control parameter group, the filter control parameter group and the amplitude control parameter group are parameter groups relating to one tone color, the parameter groups being to be supplied to the read-out circuits 15*a*, the digital control filters 15*b* and the digital control amplifiers 15*c* of the tone generator 15 so that the read-out circuits 15*a*, the digital control filters 15*b* and the digital control amplifiers 15*c* can utilize the parameter groups for generation of digital musical tone signals. The additional control parameter group is additional parameters to be supplied to the tone generator 15 and the effect circuit 17 to be utilized for the generation of digital musical tone signals of the one tone color.

The selection information sets on waveform sets correspond to the waveform sets of FIG. 3A, respectively. A set of selection information on a waveform set is formed of an original pitch, fast decay waveform selection information and slow decay waveform selection information. The original pitch, which is a parameter for pitch-shift necessary for generation of a digital musical tone signal by use of waveform data, is formed of information indicative of a pitch of a played tone recorded at the time of production of the waveform data, sampling frequency at the time of the recording of the played tone and the like. In the case of this embodiment in which waveform data is provided for each key for the sake of simplifying the explanation, only in a case where a sampling frequency at the time of the production of the waveform data is identical with a sampling frequency for the generation of a digital musical tone signal by the tone generator 15, information indicative of only the pitch (key tone pitch) of a played tone at the time of the generation of the waveform data can be employed as the original pitch. The amount of pitch-shift which is to be supplied from the above-described computer main body to the read-out circuit 15*a* is the difference between the tone pitch of a depressed key and the pitch of a played tone at the time of recording employed for the production of the waveform data. The fast decay waveform selection information is sets of top address information and end address information indicative of top and end addresses of respective storage areas of the fast decay waveform data sets included in each waveform set. The sets of top address information and end address information are arranged in order of decreasing strength of key touch. The slow decay waveform selection information is a set of top address information and end address information indicative of top and end addresses of a storage area of a slow decay waveform data set included in each waveform set.

Similarly to the above-described case, in addition, the tone color parameter memory PM stores, for percussion tones as well, the header, the waveform set control parameter group, the filter control parameter group, the amplitude control parameter group, the additional control parameter group and the selection information on a waveform set. As for the percussion tones, basically, however, one waveform set is provided for each type of musical instrument. Therefore, only in a case where the sampling frequency at the time of production of waveform data is identical with the sampling frequency for generation of a digital musical tone signal by the tone generator 15, the tone color parameter memory PM may store the fast decay waveform selection information and slow decay waveform selection information on only the one waveform set. In a case where percussion tone signals of different pitches are to be generated for one type of percussion instrument such as timpani, however, different waveform data sets corresponding to the different pitches are to be provided. Alternatively, only a set of waveform data is provided to change reproduction pitch. In the case where different waveform data sets are provided, only in a case where a sampling frequency at the time of the production of the waveform data is identical with a sampling frequency for the generation of a digital musical tone signal by the tone generator 15, as described above, the original pitch is not required. In the case where only one set of waveform data is provided, however, the information on the pitch of a played tone recorded for the production of the waveform data is required. The fast decay waveform selection information and slow decay waveform selection information is similar to that of the above-described case of decay-type musical tones generated by a key-depression.

The operation of the embodiment configured as described above will now be described. When a player manipulates any of the panel operators 13 to select a tone color of decay-type musical tones (e.g., electric piano) that will be generated by the player's performance on the keyboard 11, the CPU 21 executes a program which is not shown to read out the waveform set control parameter group, the filter control parameter group, the amplitude control parameter group and the additional control parameter group from the storage area corresponding to the selected tone color stored in the tone color parameter memory PM to temporarily store the read parameter groups in the RAM 23.

Figure 4:
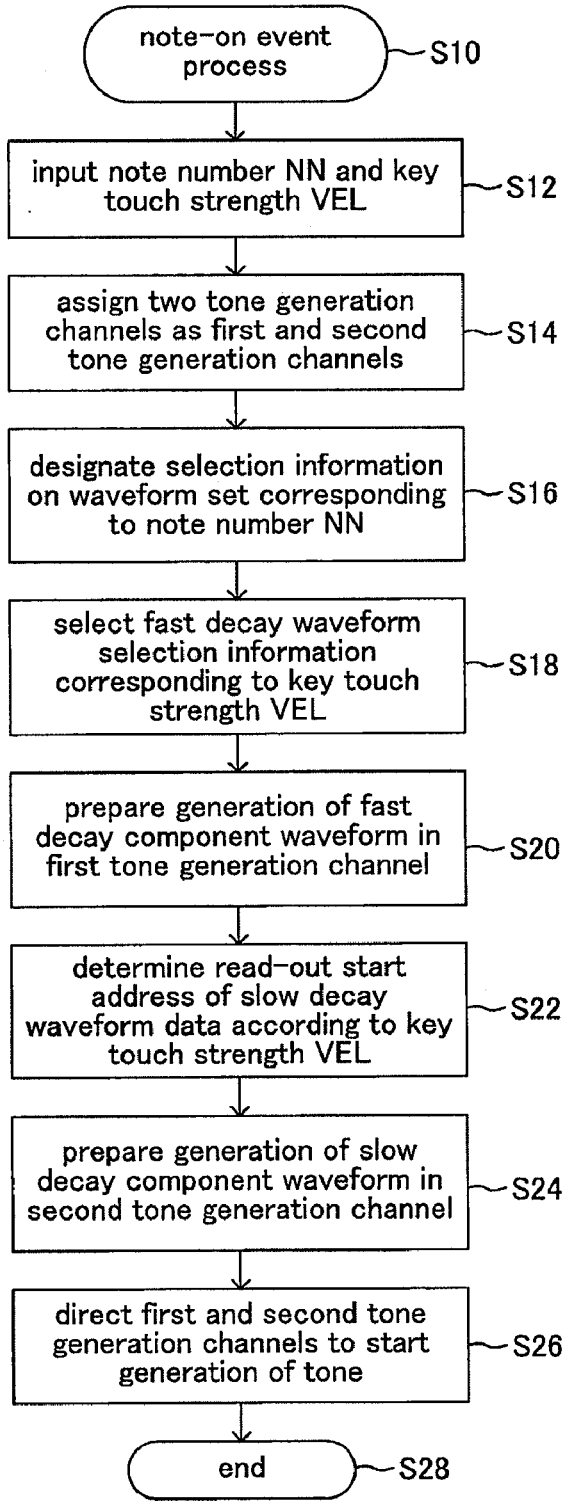
FIG. 4 is a flowchart indicating a note-on event process program.

When the player depresses any key of the keyboard 11 in this state, in other words when a note-on event is generated in response to the key depression, the CPU 21 starts the note-on event process program of FIG. 4 in step S10. On starting the note-on event process program, the CPU 21 inputs a note number NN representative of the depressed key and a key touch signal representative of the key touch strength VEL detected by the detection circuit 11*a* in step S12. These note number NN and the key touch signal are included in note-on event information which corresponds to a generation start command of the present invention for generating a musical tone signal. The CPU 21 then proceeds to step S14 to assign two unused tone generation channels included in the tone generation channels ch1 to chn of the tone generator 15 to the first and second tone generation channels for the depressed key in order to generate musical tone signals on the depressed key.

After the above-described process of step S14, the CPU 21 proceeds to step S16 to compare the input note number NN with the original pitches included in the selection information sets on the waveform sets 1, 2 . . . stored in the storage area corresponding to the selected tone color in the tone color parameter memory to designate a selection information set corresponding to the depressed key. In other words, the CPU 21 designates the selection information set on waveform set corresponding to the note number NN. Then, the CPU 21 proceeds to step S18 to select, from among sets of address information indicative of the top and end storage addresses of respective storage areas of the fast decay waveform data sets included in the designated selection information, a set of address information indicative of the top and end storage addresses of the storage area of a fast decay waveform data set corresponding to the sensed key touch strength VEL. As for the selection of the set of address information, more specifically, the CPU 21 selects, from among different levels (in this embodiment, "127", "80", "48" and "16") of key touch strength corresponding to the fast decay waveform data sets, respectively, the fast decay waveform selection information (a set of top address information and end address information) on a fast decay waveform data set having the key touch strength level which is the closest to the sensed key touch strength VEL.

Then, the CPU 21 proceeds to step S20 to execute a preparation process for generating a fast decay component waveform for the assigned first tone generation channel. In the preparation process for the fast decay component waveform, the CPU 21 outputs the selected set of top address information and end address information to the first tone generation channel of the tone generator 15 as a read-out start address and a read-out end address, also outputting the waveform set control parameter group, the filter control parameter group, the amplitude control parameter group and the additional control parameter group temporarily stored in the RAM 23 by the program process which is not shown to the first tone generation channel. In the preparation process for generating fast decay component waveform, furthermore, the CPU 21 computes tone volume level in accordance with the key touch strength VEL. More specifically, the CPU 21 computes a tone volume level which is balanced with the tone volume level of a digital musical tone signal to be generated in the second tone generation channel and then outputs a control parameter indicative of the computed tone volume level to the first tone generation channel. This preparation process is done because the respective maximum amplitudes of the fast decay waveform data sets corresponding to the different levels of key touch strength stored in the waveform memory WM are almost the same in this embodiment, so that the respective amplitudes of the fast decay waveform data sets are not correlated with the key touch strengths VEL of the fast decay waveform data sets. The first tone generation channel temporarily stores the output read-out start address, read-out end address and various kinds of control parameters including the control parameter indicative of the tone volume level to prepare generation of a digital musical tone signal.

Figure 8B:
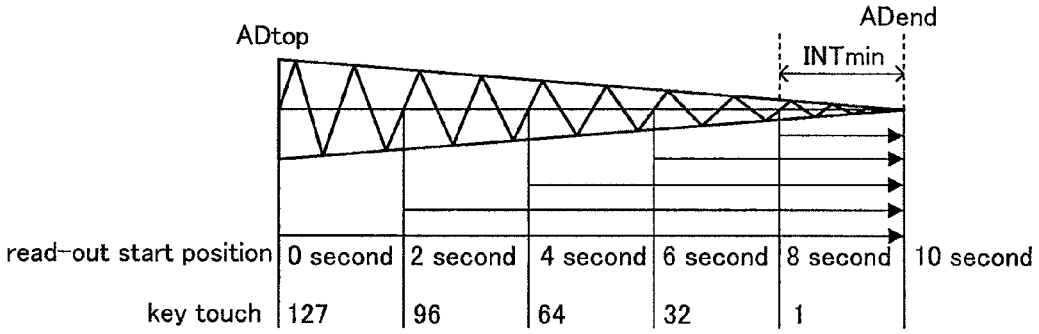
FIG. 8B is a schematic diagram indicating a waveform of a slow decay waveform data set stored in the waveform memory.

After the process of step S20, the CPU 21 proceeds to step S22 to determine an address as a read-out start address of the slow decay waveform data by use of the key touch strength VEL such that as the key touch strength VEL decreases, the read-out start address of the slow decay waveform data moves away from the storage address represented by the selected top address information to approach a storage address represented by the selected end address information. More specifically, as indicated in FIG. 8B for instance, letting the top and end storage addresses are ADtop and ADend, respectively, the read-out start address ADstart is obtained by the following Eq. 1:

$$ADstart = ADtop + (ADend - ADtop - INTmin) \cdot \{1 - (VEL - 1)/126\} \quad \text{Eq. 1}$$

INTmin contained in Eq. 1 is a fixed value representative of a value equal to the interval between the read-out start address ADstart and the end storage address ADend of a case where the key touch strength VEL is the minimum "1". In a case where the result of Eq. 1 has a decimal fraction, however, the result will be rounded off to an integer.

When the key touch strength VEL is the maximum "127", the above-described Eq. 1 results in the read-out start address ADstart being the top storage address ADtop. As the key touch strength VEL decreases, the read-out start address ADstart varies from the top storage address ADtop to approach the end storage address ADend. When the key touch strength VEL is the minimum "1", the read-out start address ADstart is an address which moves from the end storage address ADend toward the top storage address ADtop by the address interval INTmin.

However, the above-described Eq. 1 is based on a model simplified in order to facilitate the understanding of this embodiment. Therefore, the equation cannot be generalized. That is, attention must be paid not to a resultant value but to the tendency of the resultant value. Furthermore, the top address ADtop of Eq. 1 may not necessarily be the top storage address. More specifically, the top address ADtop may be any address as long as the read-out start address ADstart is to be an address which is the closest to the top address when the key touch strength VEL is the maximum "127" whereas the read-out start address ADstart moves backward from the address closest to the top as the key touch strength VEL decreases. For the calculation of the read-out start address ADstart, various functions and tables can be used according to the type of musical instrument. Particularly, the read-out start address ADstart is defined in linear scale whereas the tone volume level of digital musical tone signals (key touch strength VEL) is defined in decibel scale. Therefore, when the key touch strength VEL decreases in decibel scale, the read-out start address ADstart varies linearly to move backward from the top storage address ADtop. Such a manner of determining the read-out start address ADstart eliminates the need for controlling the tone volume level of a digital musical tone signal generated by reading of waveform data, achieving correspondence between the tone volume level of the generated digital musical tone signal and the key touch strength VEL.

Then, the CPU 21 executes a preparation process for generating a slow decay component waveform for the assigned second tone generation channel in step S24. In the slow decay component waveform preparation process, the CPU 21 outputs, along with the determined read-out start address ADstart, the end address information of the slow decay waveform data as a read-out end address to the second tone generation channel of the tone generator 15. In step S24, the CPU 21 also outputs the waveform set control parameter group, the filter control parameter group, the amplitude control parameter group and the additional control parameter group temporarily stored in the RAM 23 by the program process which is not shown to the second tone generation channel. The second tone generation channel temporarily stores the output read-out start address, the read-out end address and the various kinds of control parameters to prepare the generation of a digital musical tone signal. Although the second tone generation channel is required to control the tone volume level to balance with the tone volume level of the digital musical tone signal to be generated in the first tone generation channel, the second tone generation channel is not required to control the tone volume level in accordance with the key touch strength VEL.

After the above-described process of step S24, the CPU 21 proceeds to step S26 to direct the first and second tone generation channels to start generation of a tone. The CPU 21 then terminates the note-on event process program in step S28. In response to the directions to start generation of the tone, the first and second tone generation channels start generating digital musical tone signals. As for the first tone generation channel, more specifically, the read-out circuit 15*a* of the first tone generation channel increments address from the read-out start address with the passage of time, also sequentially reading out the fast decay waveform data stored in the waveform memory WM to generate a digital musical tone signal formed of a fast decay component waveform represented by the fast decay waveform data to output the generated digital musical tone signal. In this case, this embodiment is designed such that the sampling frequency of a played tone at the time of production of waveform data is identical with the sampling frequency for the generation of a digital musical tone signal by the tone generator 15, with a waveform set being provided for each key. Therefore, this embodiment eliminates the need for pitch-shift, while the embodiment is designed to increment the address by "1" at each sampling cycle. In other cases, however, the control for pitch-shift is necessary. The read-out circuit 15*a* finishes reading the fast decay waveform data at a point in time when the increment of the address reaches the read-out end address. At the point in time when the reading of the fast decay waveform data completes, the first tone generation channel is released to be an unused channel. As a result, the fast decay component waveform is generated on the basis of the fast decay waveform data specified by the note number NN and the key touch VEL.

The frequency response of the digital musical tone signal output from the read-out circuit 15*a* is controlled by the digital control filter 15*b*, whereas the amplitude response of the digital musical tone signal is controlled by the digital control amplifier 15*c* before the digital musical tone signal is output to the channel summing circuit 15*d*. As for the control of amplitude response in the first tone generation channel, particularly, the digital control amplifier 15*c* controls, by use of the control parameter representative of the tone volume level supplied to the tone generator 15 in the process of step S20, tone volume level of the digital musical tone signal in accordance with the key touch strength VEL. In this case, without directions for start of release or directions for fast decay as described later, basically, the digital control amplifier 15*c* will not vary the amplitude response of the digital musical tone signal based on the read fast decay waveform data with time.

As for the second tone generation channel as well, the read-out circuit 15*a* of the second tone generation channel increments address from the read-out start address with the passage of time, also sequentially reading out the slow decay waveform data stored in the waveform memory WM to generate a digital musical tone signal formed of a slow decay component waveform represented by the slow decay waveform data to output the generated digital musical tone signal. In this case as well, this embodiment is designed such that the sampling frequency of a played tone at the time of production of waveform data is identical with the sampling frequency for the generation of a digital musical tone signal by the tone generator 15, with a waveform set being provided for each key. In this case, therefore, this embodiment eliminates the need for pitch-shift, while the embodiment is designed to increment the address by "1" at each sampling cycle. In other cases, however, the control for pitch-shift is necessary. The read-out circuit 15*a* finishes reading the slow decay waveform data at a point in time when the increment of the address reaches the read-out end address. At the point in time when the reading of the slow decay waveform data completes, in this case as well, the second tone generation channel is released to be an unused channel. As a result, the reading of the slow decay waveform data specified by the note number NN is started from the read-out start address specified by the key touch strength VEL to generate the slow decay component waveform on the basis of the read slow decay waveform data.

The frequency response of the digital musical tone signal output by the read-out circuit 15*a* is also controlled by the digital control filter 15*b*, whereas the amplitude response of the digital musical tone signal is controlled by the digital control amplifier 15*c* before the digital musical tone signal is output to the channel summing circuit 15*d*. As for the control of amplitude response in the second tone generation channel, unlike the first tone generation channel, the tone volume level of the digital musical tone signal according to the key touch strength VEL depends on the read-out start address ADstart of the slow decay waveform data. Therefore, the control of the tone volume level according to the key touch strength VEL will not be done, but the other type of control of the tone volume level is done as needed. In this case as well, without directions for start of release or directions for fast decay as described later, basically, the digital control amplifier 15*c* will not vary the amplitude response of the digital musical tone signal based on the read fast decay waveform data with time.

The channel summing circuit 15*d* adds the digital musical tone signal formed of the fast decay component waveform output by the first tone generation channel to the digital musical tone signal formed of the slow decay component waveform output by the second tone generation channel to mix the digital musical tone signals together to output the mixed signal to the effect circuit 17. The effect circuit 17 adds effects to the digital musical tone signal on the basis of effect control parameters supplied by an execution of a program which is not shown to output the digital musical tone signal to which the effects have been added to the sound system 18. The sound system 18 converts the output digital musical tone signal into an analog musical tone signal to emit a musical tone through the speakers.

As for the generation of musical tone signals as described above, in a case where a key depression by the player lasts long enough to allow the address of the slow decay waveform data read by the read-out circuit 15*a* of the tone generation channel of the tone generator 15 to reach the read-out end address, the whole fast decay waveform data and slow decay waveform data is to be output as the digital musical tone signals. However, if the depressed key is released during the generation of the digital musical tone signals, the CPU 21 executes a program which is not shown to output signals for demanding to start releasing the two tone generation channels of the tone generator 15 which are assigned for the generation of the musical tone for the depressed key. The digital control amplifiers 15*c* of the two tone generation channels of the tone generator 15 relatively quickly decay the amplitudes of the digital musical tone signals transmitted from the digital control filters 15*b*. More specifically, the digital control amplifiers 15*c* release the digital musical tone signals transmitted from the digital control filters 15*b*. In synchronization with the release of the digital musical tone signals, the digital control filters 15*b* change the frequency response of the digital musical tone signals in some degree as necessary. As soon as the tone generation channel has completely decayed the digital musical tone signal by the release of the digital musical tone signal, the tone generation channel is released to be an unused channel.

In a case where the number of the tone generation channels is not enough due to depression/release of multiple keys of the keyboard 11 in a short period of time, the CPU 21 executes a program which is not shown to output, to the tone generation channel generating a digital musical tone signal having the smallest amplitude level among the tone generation channels assigned for released keys, a signal for demanding starting quick decay of the digital musical tone signal. The digital control amplifier 15*c* of the tone generation channel which has received the signal from the CPU 21 quickly decays the amplitude of the digital musical tone signal transmitted from the digital control filter 15*b*. In synchronization with the quick decay by the digital control amplifier 15*c*, in this case as well, the digital control filter 15*b* changes the frequency response of the digital musical tone signal in some degree as necessary. In this case as well, furthermore, as soon as the tone generation channel has completely decayed the digital musical tone signal, the tone generation channel is released to be an unused channel. Even in the case where multiple keys are depressed or released in a short period of time, therefore, a tone generation channel for generating a musical tone of a newly depressed key is always secured.

Next, a case where any one of the performance operators 12 is manipulated to generate a percussion tone will be described. The CPU 21 executes a modified program (not shown) obtained by modifying the note-on event process program shown in FIG. 4 to control generation of a percussion tone. The modified program is started in response to inputting of a switch-on signal SWON by the detection circuit 12*a*. In the modified program, the input of the note number NN and the key touch strength VEL in step S12 of FIG. 4 is replaced with the input of musical instrument type information IN and operator touch strength VEL sensed by the detection circuit 12*a*. In addition, the designation of the selection information on waveform set corresponding to the note number NN in step S16 is replaced with designation of a storage area which is selected from among the plurality of storage areas provided in the tone color parameter memory PM and corresponds to the tone color of a percussion instrument represented by the input musical instrument type information IN. Then, the waveform set control parameter group, the filter control parameter group, the amplitude control parameter group and the additional control parameter group stored in the designated storage area are read out to be temporarily stored in the RAM 23. In this case, a set of selection information (fast decay waveform selection information and slow decay waveform selection information) which is the only one selection information stored in the storage area is designated. In this modified program, the processes of the other steps S14 and S18 to S26 of FIG. 4 are done similarly to the case of the control process for generation of musical tone signals by the key depression.

In a case as well where any one of the performance operators 12 is manipulated to activate, therefore, a set of fast decay waveform data included in sets of fast decay waveform data is designated according to the operator touch strength VEL. In addition, the address where the reading of a set of slow decay waveform data starts is determined according to the operator touch strength VEL. In the generation of a percussion tone by the manipulation of the performance operator 12 as well as the case of depression of a key, therefore, a digital musical tone signal based on the set of fast decay waveform data designated according to the operator touch strength VEL and a digital musical tone signal based on the slow decay waveform data whose read-out start address is determined according to the operator touch strength VEL are mixed together to be output. In the case of the digital musical tone signals of the percussion tones as well as the case of the digital musical tone signals having a tone pitch corresponding to the key tone pitch, furthermore, the tone volume level of the fast decay waveform data to be mixed is controlled to have a tone volume level corresponding to the operator touch strength VEL.

In a case as well where key performance event data and percussion instrument performance event data is read out by reproduction of automatic performance data by execution of an automatic performance program which is not shown, furthermore, decay-type musical tones by key performance and percussion tones are generated by the execution of the note-on event process program shown in FIG. 4 and its modified program. In the automatic performance data, more specifically, the key performance event data formed of key-on and key off events including the key touch strength VEL and the note number NN and the percussion instrument performance event data formed of percussion instrument manipulation events including the operator touch strength VEL and the musical instrument type information IN are stored according to the passage of time. In automatic rhythm data, percussion instrument performance event data formed of percussion instrument manipulation events including the operator touch strength VEL and the musical instrument type information IN is stored according to the passage of time. The key performance event data and the percussion instrument performance event data is the same as the key-on signal KON, the key-off signal KOF, the note number NN, the key touch strength VEL, the switch-on signal SWON, the operator touch strength VEL, the musical instrument type information IN and the like output by the detection circuits 11*a*, 12*a* of the embodiment. If the generation of musical tones is controlled as described above by use of the key performance event data and the percussion instrument performance event data output at the time of reproduction of automatic performance data and automatic rhythm data, therefore, the musical tones generated by the automatic performance and automatic rhythm are completely similar to those generated by use of the keyboard 11 and the performance operators 12.

According to this embodiment, as apparent from the above explanation about the embodiment, the waveform memory WM stores the fast decay waveform data formed of sets of waveform data extracted from tones played in different levels of strength and slow decay waveform data formed of a set of waveform data extracted from a tone played in a high strength. The first tone generation channel which is provided in the tone generator 15 and to which generation of a tone is assigned selects a set of waveform data in accordance with information on strength (the key touch strength VEL and the operator touch strength VEL) from among the sets of waveform data provided as the fast decay waveform data to read out the selected waveform data to generate a digital musical tone signal which is a fast decay component waveform on the basis of the read fast decay waveform data. The tone volume level of the digital musical tone signal which is the fast decay component waveform is controlled in accordance with the key touch strength VEL or the operator touch strength VEL. The second tone generation channel which is provided in the tone generator 15 and to which generation of a tone is assigned reads out the set of waveform data provided as the slow decay waveform data to generate a digital musical tone signal which is a slow decay component waveform on the basis of the read slow decay waveform data. Then, the channel summing circuit 15*d* mixes the digital musical tone signal generated by the first tone generation channel and the digital musical tone signal generated by the second tone generation channel together to output the mixed signal.

Although fast decay component waveforms vary depending on the strength of a generated musical tone, slow decay component waveforms rarely vary depending on the strength of a generated musical tone. Therefore, the mixed digital musical tone signal can represent, with high accuracy, a waveform of a musical tone to be generated, the waveform varying depending on the strength. Consequently, the above-described embodiment is able to generate realistic musical tone signals. In addition, the waveform memory WM only stores the sets of fast decay waveform data representative of fast decay component waveforms that take a short period of time from the start to the end of generation and the set of slow decay waveform data representative of a slow decay waveform that takes a long period of time from the start to the end of generation. Therefore, the embodiment is able to reduce the amount of waveform data required for generation of musical tone signals, eliminating the need for the waveform memory WM of a large capacity. Furthermore, the time during which the first tone generation channel is used for generation of a digital musical tone signal which is a fast decay component waveform is limited to a short period of time immediately after the start of the generation of the musical tone signal. Even though the embodiment requires two tone generation channels in order to generate one musical tone, therefore, the duration in time that the tone generation channel is occupied is not that long, compared with a scheme which occupies only a tone generation channel for generation of a musical tone.

The second tone generation channel reads out waveform data provided as slow decay waveform data stored in the waveform memory WM with the passage of time, determining the read-out start address such that as the strength of a musical tone signal represented by the strength information decreases, the read-out start address is placed further away from the top address of the waveform data. As the strength of a musical tone signal to be generated decreases, therefore, the time taken from the start to the end of the reading of the waveform data shortens to shorten the time taken from the start to the end of generation of the musical tone signal. Such a characteristic of the embodiment coincides with a characteristic of decay-type musical tones of musical instruments that as the strength of a generated musical tone decreases, the time taken from the start to the end of generation of the musical tone shortens. As a result, the embodiment is able to more favorably imitate decay-type musical tones by the simple scheme of changing the read-out start address depending on the strength information.

In addition, the first tone generation channel is designed to control the tone volume level of a digital musical tone signal in accordance with the key touch strength VEL or the operator touch strength VEL at the time of generation of the digital musical tone signal which is a fast decay component waveform. Even in a case where the waveform memory WM is to store fast decay waveform data of a musical tone signal having a low level of strength, therefore, the fast decay waveform data is allowed to increase the amplitude level to enable reproduction of the fast decay waveform data with high accuracy.

The present invention is not limited to the above-described embodiment but can be variously modified without departing from the scope of the present invention.

The above-described embodiment is designed such that for a designation of a set of fast decay waveform data provided in the waveform memory WM, a set of fast decay waveform data corresponding to the key touch strength which is the closest to the key touch strength VEL is selected to generate a digital musical tone signal by use of the selected set of fast decay waveform data. However, the above-described embodiment may be modified such that two sets of fast decay waveform data corresponding to two different levels of key touch strength which sandwich the key touch strength VEL are selected from among the plurality of fast decay waveform data sets corresponding to the different levels of key touch strength to generate a digital musical tone signal by interpolating (crossfading) the selected two sets of fast decay waveform data.

Figure 5:
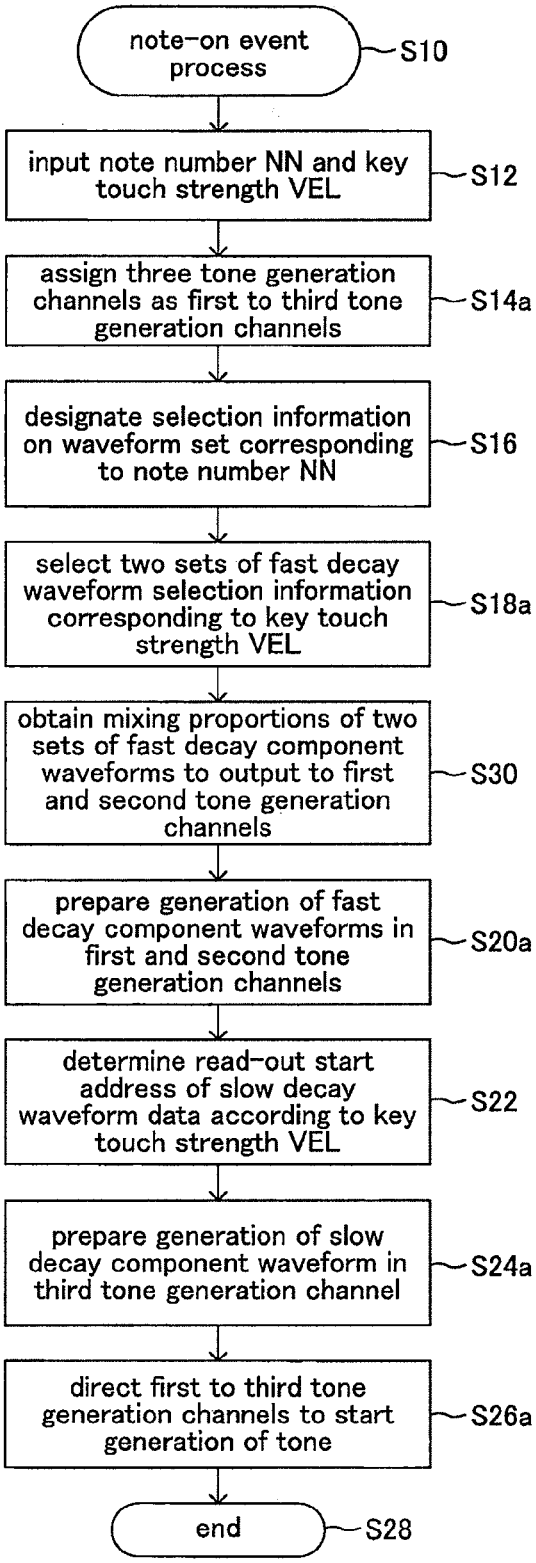
FIG. 5 is a flowchart indicating another note-on event process program.
Figure 6A:
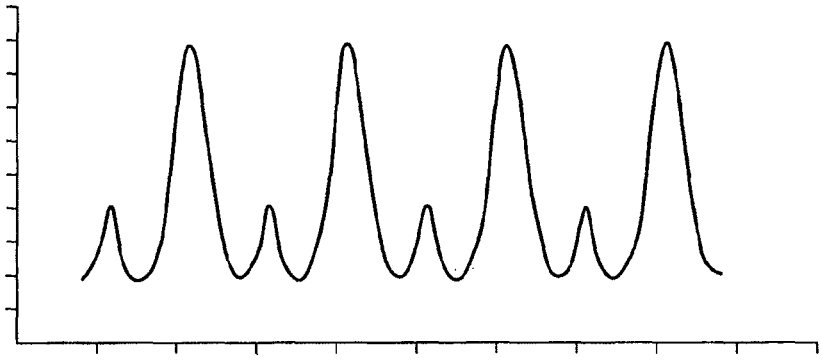
FIG. 6A simulates a waveform of a decay-type musical tone right after the start of generation thereof.
Figure 6B:
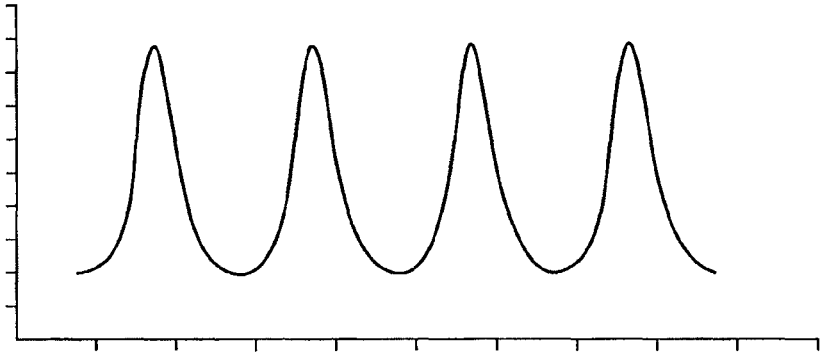
FIG. 6B simulates a waveform of the decay-type musical tone of a state in which a certain time period has elapsed since the start of generation of the musical tone to allow the waveform to be stable.
Figure 7A:
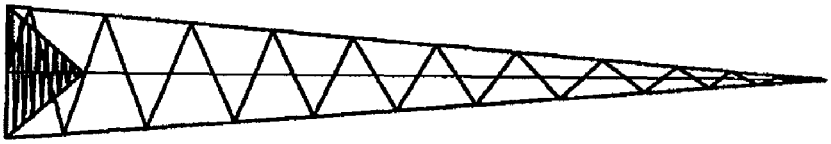
FIG. 7A simulates waveforms of decay-type musical tones as a whole.
Figure 7B:
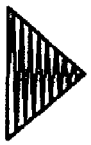
FIG. 7B simulates fast decay component waveforms included in the waveforms of the musical tones.
Figure 7C:
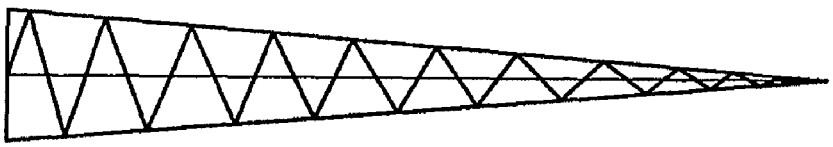
FIG. 7C simulates slow decay component waveforms included in the waveforms of the musical tones.

In this modified case, the ROM 22 or the external storage device 25 stores a note-on event process program shown in FIG. 5 which is a modification of the note-on event program of FIG. 4. The CPU 21 executes the note-on event process program of FIG. 5. In the note-on event process program of FIG. 5, steps identical with those of the note-on event process program of FIG. 4 are given the numbers identical with those of the note-on event process program of FIG. 4 to omit explanations of such steps.

As for the note-on event process program of FIG. 5, in step S14*a* which is a replacement for step S14 of FIG. 4, in order to generate musical tone signals on a depressed key, the CPU 21 selects three unused tone generation channels from among a plurality of tone generation channels provided in the tone generator 15 to assign the three tone generation channels as first to third tone generation channel to the key. In step S18*a* which is a replacement for step S18 of FIG. 4, the CPU 21 selects, from among sets of address information representative of the top and end storage addresses of respective storage areas of sets of fast decay waveform data included in the selection information, two sets of address information (the top address information and the end address information) representative of respective top and end storage addresses of the storage areas of two sets of fast decay waveform data corresponding to two levels of key touch strength which sandwich the key touch strength VEL.

In step S30, the CPU 21 calculates the mixing ratio of the two fast decay component waveforms represented by the selected two fast decay waveform data sets. In this case, defining the two key touch strengths sandwiching the key touch strength VEL as VEL1, VEL2, respectively, and also defining the mixing proportions of the fast decay component waveforms corresponding to the key touch strengths VEL1, VEL2 as MIX1, MIX2, respectively, the mixing proportions MIX1, MIX2 are obtained by the following Eqs. 2, 3:

$$MIX1=|VEL2-VEL|/|VEL1-VEL2| \quad \text{Eq. 2}$$

$$MIX2=|VEL1-VEL|/|VEL1-VEL2| \quad \text{Eq. 3}$$

By such a proportional distribution, as a result, the mixing proportions of the two fast decay component waveforms are obtained as MIX1, MIX2, respectively, so that the mixing of the two fast decay component waveforms results in a composite waveform obtained by interpolation according to the key touch strength VEL. The obtained mixing proportions MIX1, MIX2 are output to the assigned first and second tone generation channels of the tone generator 15, respectively.

Similarly to the case of the above-described Eq. 1, however, the Eqs. 2, 3 are based on a model simplified in order to facilitate the understanding of this embodiment. Therefore, the equations cannot be generalized. That is, attention must be paid not to resultant values but to the tendency of resultant values. Particularly, the mixing proportions MIX1, MIX2 are actually represented not in linear scale but in decibel scale. Actually, the mixing proportions MIX1, MIX2 require not only the element of cross-fading indicated by Eqs. 2, 3 but also an element of control of the tone volume level according to the key touch strength VEL. That is, decibel values of the mixing proportions MIX1, MIX2 have to be values that have been controlled such that the tone volume of the mixed fast decay component waveform is a tone volume level corresponding to the key touch strength VEL. More specifically, the tone volume level (decibel value) of the digital musical tone signal which is the above-described slow decay component waveform is to be added to the right side of the Eqs. 2, 3.

In step S20*a* which is a replacement for step S20 of FIG. 4, the CPU 21 executes a preparation process for generating the selected two fast decay component waveforms for the assigned first and second tone generation channels. In the preparation process for the fast decay component waveforms, the CPU 21 outputs one of the selected two sets of address information to the first tone generation channel of the tone generator 15 as a read-out start address and a read-out end address. The CPU 21 also outputs the other one of the two sets of address information to the second tone generation channel of the tone generator 15 as a read-out start address and a read-out end address. Similarly to the above-described embodiment, the CPU 21 also outputs the waveform set control parameter group, the filter control parameter group, the amplitude control parameter group and the additional control parameter group to the first and second tone generation channels. The first and second tone generation channels temporarily store the output read-out start address, read-out end address and various kinds of control parameters to prepare generation of digital musical tone signals.

In step S24*a* which is a replacement for step S24 of FIG. 4, the CPU 21 executes the preparation process for generating a slow decay component waveform for the assigned third tone generation channel, the preparation process being similar to that of the above-described embodiment. In step S26*a* which is a replacement for step S26 of FIG. 4, the CPU 21 directs the first to third tone generation channels to start generation of a tone. The other steps of the modified program are done similarly to those of the program of FIG. 4.

By the execution of the note-on event process program according to the above-described modification, in response to the directions to start generation of a tone, the first to third tone generation channels provided in the tone generator 15 start generating digital musical tone signals. In this case, the first and second tone generation channels generate digital musical tone signals indicative of the two fast decay component waveforms, respectively, in accordance with the two different fast decay waveform data sets to output the generated digital musical tone signals. In the first tone generation channel, the digital control amplifier 15*c* multiplies the digital musical tone signal output by the digital control filter 15*b* by the mixing proportion MIX1 output in step S30 to control such that the amplitude of the digital musical tone signal is proportional to the mixing proportion MIX1. In the second tone generation channel, the digital control amplifier 15*c* multiplies the digital musical tone signal output by the digital control filter 15*b* by the mixing proportion MIX2 output in step S30 to control such that the amplitude of the digital musical tone signal is proportional to the mixing proportion MIX2.

The third tone generation channel generates a digital musical tone signal indicative of a slow decay component waveform in accordance with the slow decay waveform data to output the generated digital musical tone signal. The generation of the digital musical tone signals in the first to third tone generation channels is done similarly to the above-described embodiment. The digital musical tone signals output from the first to third tone generation channels are output to the channel summing circuit 15*d*, respectively. The channel summing circuit 15*d* sums the digital musical tone signals output from the first to third tone generation channels to output the summed signal. As a result, the two fast decay component waveforms output from the first and second tone generation channels are mixed in the mixing proportions MIX1, MIX2, also being mixed with the slow decay component waveform output from the third tone generation channel.

The generation of the two fast decay component waveforms in this modification is also applied to the generation of percussion tones by the performance operators 12, the generation of automatic performance tones based on automatic performance data, and the generation of automatic rhythm tones (percussion tones) based on automatic rhythm data as well.

According to this modification, as a result, the fast decay waveform data which is to be mixed is obtained by interpolating (crossfading), in accordance with the strength of a musical tone signal represented by the strength information (the key touch strength VEL and the operator touch strength VEL) and the two levels of strength which sandwich the strength of the musical tone signal, the waveform data sets of the two levels of strength which sandwich the strength. Therefore, even if the number of waveform data sets corresponding to different levels of strength stored as the fast decay waveform data in the waveform memory WM is reduced, this modification is able to obtain, with high accuracy, fast decay waveform data according to the strength of the musical tone signal represented by strength information.

The above-described embodiment and the modification are designed, by step S22 of FIG. 4 and FIG. 5, to calculate the address value which linearly varies from the address ADend–INTmin to the address ADtop as the read-out start address of the slow decay waveform data, as the key touch strength VEL (or the operator touch strength VEL) varies from the minimum value "1" to the maximum value "127". However, the embodiment and the modification may be modified to provide a function which defines an address value which nonlinearly varies from the address ADend–INTmin to the address ADstart as the key touch strength VEL varies from the minimum value "1" to the maximum value "127" to obtain the address value which nonlinearly varies with respect to variations in the key touch strength VEL or the operator touch strength VEL by use of the function.

Furthermore, the embodiment and the modification may be modified to store a plurality of read-out start positions to correlate with a plurality of key touch strengths VEL (or operator touch strengths VEL) so that the process of step S22 of FIG. 4 and FIG. 5 may determine the read-out start address of the slow decay waveform data by use of the stored read-out start positions. In this case, the embodiment and the modification may be designed to store, as the slow decay waveform selection information on each waveform set, not only the top and end addresses of the storage area of the slow decay waveform data but also pieces of mid-address information representative of a plurality of read-out start addresses corresponding to different strengths of a musical tone signal to be generated, the mid-addresses being situated between the top and end addresses. As indicated in FIG. 8B, the mid-address information pieces represent the read-out start addresses correlated with the key touch strengths VEL "96", "64", "32", "1", for example. If the addresses are converted into time regarding the reading out of the waveform data with the read-out start position of the key touch strength VEL of the maximum value "127" being defined as "0 second", the above-described four mid-addresses correspond to the positions of "2 seconds", "4 seconds", "6 seconds" and "8 seconds" counted from the top, respectively.

In step S22 of FIG. 4 and FIG. 5, if the key touch strength VEL input in step S12 is the maximum key touch (i.e., "127"), the top address of the slow decay waveform data included in the slow decay waveform selection information of the selection information designated in step S16 is determined as the read-out start address. If the key touch strength VEL agrees with any one of the key touch strengths "96", "64", "32" "1", a piece of mid-address information corresponding to the agreed key touch strength VEL is determined as the read-out start address. If the key touch strength VEL does not agree with any of the key touch strengths "127", "96", "64", "32" and "1", two key touch strengths which sandwich the key touch strength VEL input in step S12 are selected from among the various levels of key touch strength. If the selected two key touch strengths are taken as VEL1, VEL2 (VEL1>VEL2), and two mid-addresses corresponding to the key touch strengths VEL1, VEL2 are taken as AD1, AD2 (AD2>AD1), the read-out start address ADstart is obtained by an interpolation of the following Eq. 4. As in the cases of Eqs. 1 to 3, however, the Eq. 4 is also based on a model simplified in order to facilitate the understanding of this embodiment. Therefore, the equation cannot be generalized. That is, attention must be paid not to a resultant value but to the tendency of resultant value.

$$ADstart = AD1 + (AD2 - AD1)\cdot(VEL - VEL1)/(VEL2 - VEL1) \quad \text{Eq. 4}$$

As described above, in the case where the read-out start addresses corresponding to the key touch strengths "96", "64", "32", "1" are determined as the mid-address information pieces, the intervals between the key touch strengths VEL are almost uniform. That is, the interval is "31" or "32". Therefore, the read-out start address varies almost linearly according to the key touch strength VEL (or the operator strength VEL). However, the read-out start address can vary nonlinearly with respect to the variations in the key touch strength VEL by varying the intervals of the addresses represented by the mid-addresses such as by gradually extending the intervals.

As for the waveforms of decay-type musical tones whose frequency varies according to key tone pitch, the above-described embodiment and the modification are designed such that the waveform sets provided for each tone color stored in the waveform memory WM are provided to correspond to the respective key tone pitches (note numbers NN). As for the waveforms of decay-type musical tones, however, the embodiment and the modification may be modified such that the waveform sets provided for each tone color stored in the waveform memory WM are provided to correspond to respective key tone ranges each containing a plurality of key tone pitches (e.g., half-octave). In this case, the waveform memory WM stores a plurality of waveform sets corresponding to the plurality of key tone ranges, respectively. In this case, furthermore, the storage area corresponding to each tone color provided in the tone color parameter memory PM stores not only the header and the various control parameters but also selection information on the waveform sets corresponding to the plurality of key tone ranges. The selection information on each waveform set is configured similarly to that of the above-described embodiment. More specifically, the original pitch contained in the selection information includes information representative of the pitch of an originally played tone provided at the time of production of the waveform data on the waveform set. In this modification, in accordance with the difference between the key tone pitch designated by the note number NN of a depressed key and the pitch of the played tone included in the original pitch, digital musical tone signals (digital musical tone signals indicative of a fast decay component waveform and a slow decay component waveform) of the key tone pitch designated by the note number NN are generated.

Firstly, more specifically, the CPU 21 selects the selection information on the waveform set of a key tone range to which the depressed key belongs from the tone color parameter memory PM to output address information on fast decay waveform data and slow decay waveform data included in the selected selection information to the first and second tone generation channels (or the first to third tone generation channels) to which the depressed key is assigned, respectively. As for the address information on fast decay waveform data, however, similarly to the case of the above-described embodiment, a piece (or two pieces) of address information on fast decay waveform data corresponding to the key touch strength VEL is selected. Concurrently with the output of the address information, the CPU 21 also outputs the difference between the key tone pitch corresponding to the depressed key and the pitch represented by the original pitch included in the selected selection information as the amount of pitch-shift (cent) to the first and second tone generation channels (or the first to third tone generation channels).

The read-out circuits 15*a* of the first and second tone generation channels (or the first to third tone generation channels) determine the read-out rate of the waveform data in accordance with the amount of pitch-shift to read out the fast decay waveform data and the slow decay waveform data designated by the address information. As a result, the read-out circuits 15*a* generate digital musical tone signals of a key tone pitch corresponding to the note number NN to output the generated digital musical tone signals to the digital control filters 15*b*, respectively. Because the read-out rate determined in accordance with the amount of pitch-shift usually includes a decimal fraction, the read-out address of the waveform data is formed of an integer and a decimal fraction. In the reading of the waveform data, therefore, the integer is used to read out a plurality of sample values of the waveform data, whereas the decimal fraction is used to perform an interpolation to ultimately generate digital musical tone signals. Processes done in this modification after the generation of the digital musical tone signals are the same as those of the above-described embodiment. Furthermore, this modification is also predicated on that the sampling frequency at the time of production of waveform data is the same as the sampling frequency at the time of generation of a digital musical tone signal by the tone generator 15. In a case where the sampling frequency is different between them, it is necessary to determine the amount of pitch-shift in consideration of the difference in the sampling frequency.

b. Method of Producing Waveform Data

Production of the fast decay waveform data and the slow decay waveform data stored in the waveform memory WM will be described.

b1. Waveform Data Producing Apparatus

Figure 9:
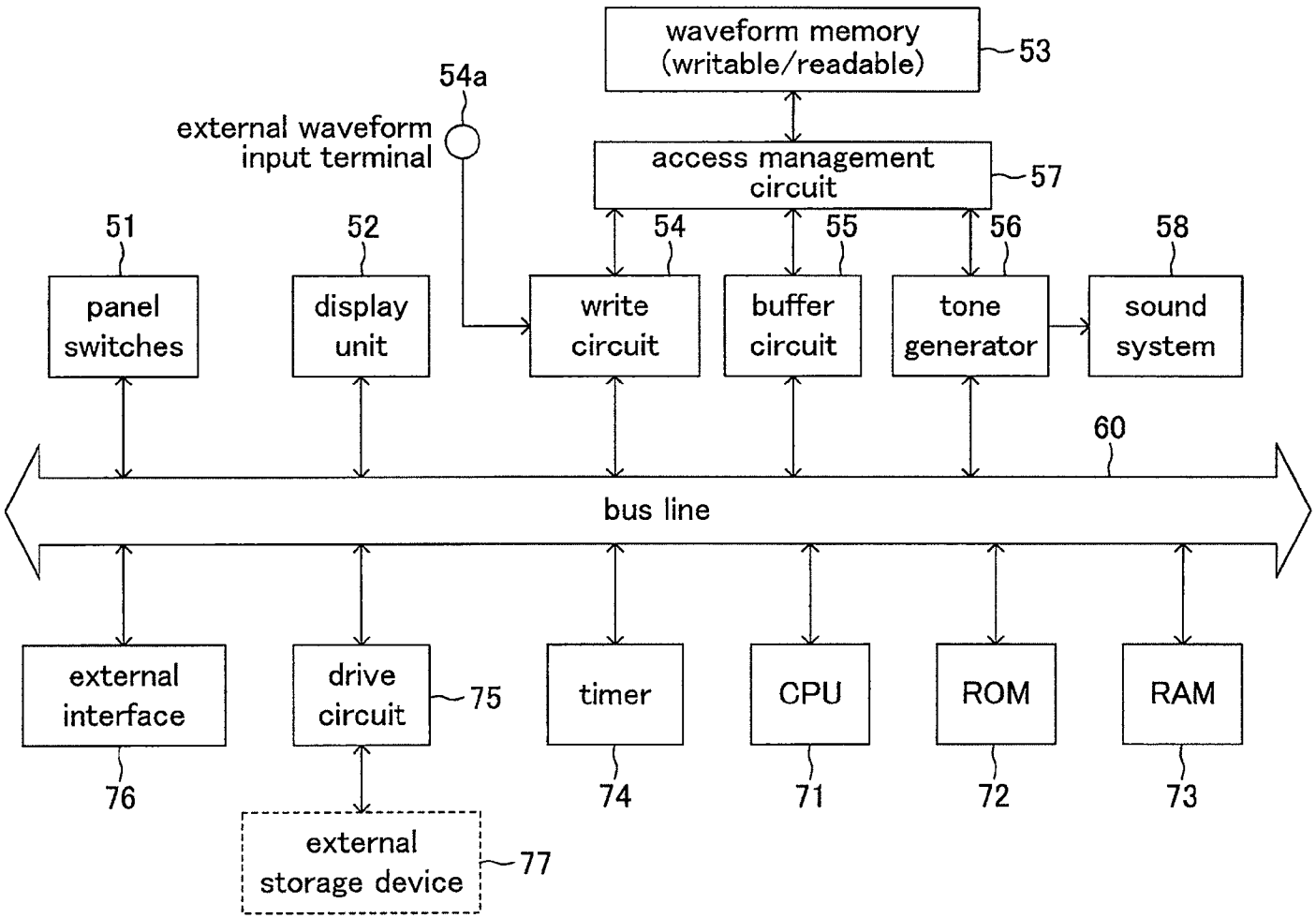
FIG. 9 is a general block diagram indicating a waveform data producing apparatus.

Firstly, a waveform data producing apparatus for producing fast decay waveform data and slow decay waveform data will be described. As indicated in FIG. 9, the waveform data producing apparatus has a plurality of panel switches 51, a display unit 52, a waveform memory 53, a write circuit 54, a buffer circuit 55, a tone generator 56 and an access management circuit 57.

The panel switches 51, which are provided on an operating panel, are operated by a manipulator to demand operations of the waveform data producing apparatus. The display unit 52, which is configured by a liquid crystal display provided on the operating panel, displays characters, numerals, graphics, particularly, waveforms of musical tones and analytical results of waveforms, and the like. The panel switches 51 and the display unit 52 are connected to a bus 60, respectively.

The waveform memory 53, which is formed of a writable and readable memory, stores waveform data representative of original waveforms (waveforms of musical tones of musical instruments) and waveform data produced in the waveform data producing apparatus. The write circuit 54 controls writing of waveform data into the waveform memory 53. To the write circuit 54, an input terminal 54*a* for inputting waveform data representative of waveforms of musical tones of musical instruments is connected, the waveform data being obtained by sampling waveforms of musical tones of various kinds of musical instruments at a predetermined sampling rate to be A/D converted. The buffer circuit 55 controls the transfer of waveform data from the waveform memory 53 to another circuit and the transfer of waveform data from another circuit to the waveform memory 53. The tone generator 56 generates digital musical tone signals by use of the waveform data read out from the waveform memory 53 to output the generated digital musical tone signals to a sound system 58. The sound system 58, which includes a D/A converter, analog amplifiers and speakers, emits musical tones corresponding to the digital musical tone signals supplied from the tone generator 56. The write circuit 54, the buffer circuit 55 and the tone generator 56 are also connected to the bus 60, respectively. The access management circuit 57 is connected between the waveform memory 53 and the write circuit 54, the buffer circuit 55 and the tone generator 56 to manage access time slot for the waveform memory 53 in order to avoid collision between the writing of waveform data by the write circuit 54 into the waveform memory 53, the transfer of waveform data by the buffer circuit 55 to the waveform memory 53 and the reading of waveform data by the tone generator 56 from the waveform memory 53.

The waveform data producing apparatus also has a CPU 71, a ROM 72, a RAM 73, a timer 74, a drive circuit 75 and an external interface circuit 76 which are connected to the bus 60, respectively. The CPU 71, the ROM 72 the RAM 73 and the timer 74 form the computer main body. Particularly, the CPU 71 executes later-described waveform data production programs. The drive circuit 75 controls storing and reading of various kinds of data and programs in/from an external storage device 77 such as a hard disk HD, a flash memory and a compact disk CD. The external interface circuit 76 enables the waveform data producing apparatus to connect with an external MIDI apparatus such as an electronic musical instrument or a sequencer, also enabling the waveform data producing apparatus to connect with a server through a communications network. The above-described waveform data production programs are stored in the external storage device 77 or retrieved through the external interface circuit 76 to be stored in the RAM 73 or the external storage device 77. Hereafter, various methods of producing fast decay waveform data and slow decay waveform data by use of the waveform data producing apparatus will be described.

b2. First Waveform Data Production Method

A first method of producing waveform data will be described. Firstly, the manipulator prepares digital waveform data representative of a waveform of a decay-type musical tone of a desired strength of a desired tone pitch of a desired type of musical instrument (hereafter the digital waveform data will be referred to as original waveform data). In a case of a musical tone of a percussion instrument, however, the manipulator prepares original waveform data representative of a desired strength of a desired type of musical instrument. The original waveform data represents a waveform of a musical tone of a musical instrument, the waveform representing from the start to the end of emission of a musical tone. For the preparation of the original waveform data, an apparatus in which the original waveform data has been previously stored is connected with the input terminal 54*a*. Alternatively, the original waveform data may be previously stored in the external storage device 77 or may be retrieved through the external interface circuit 76.

Figure 10:
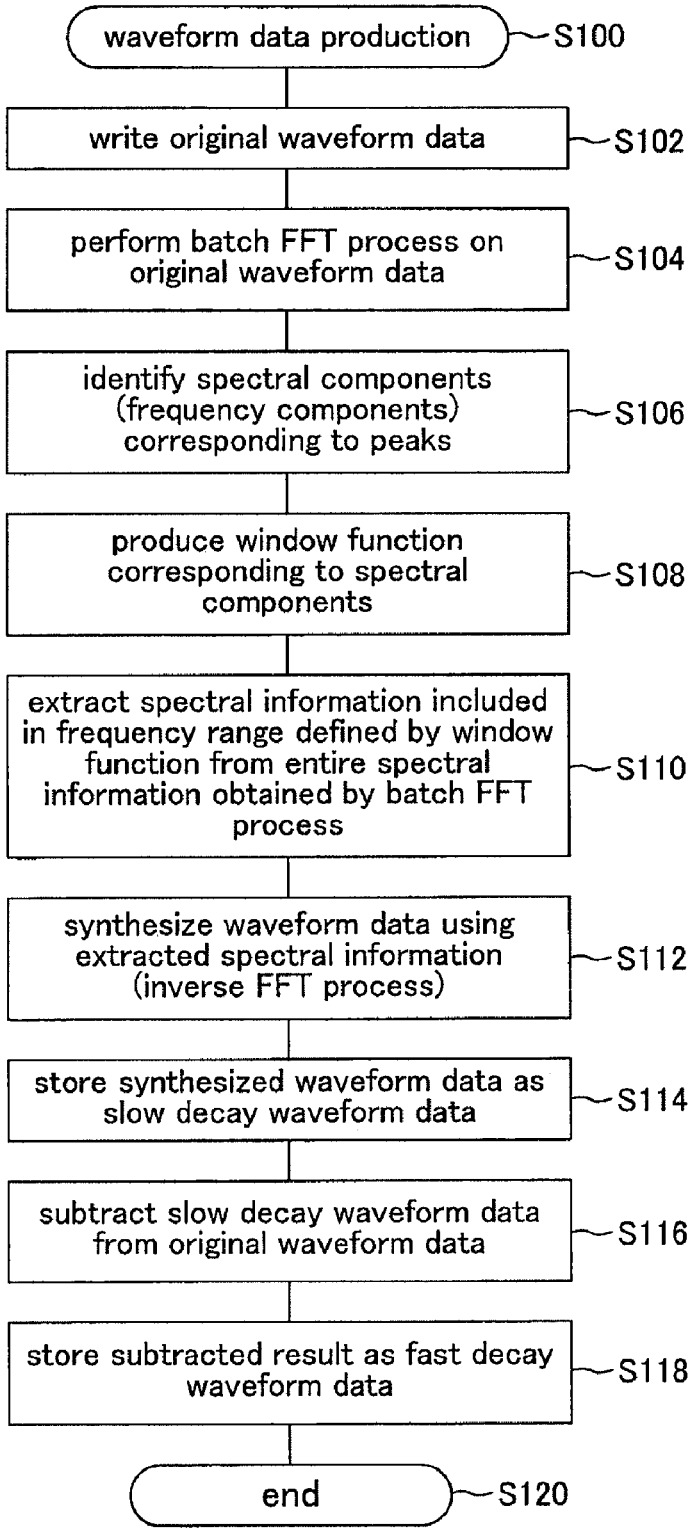
FIG. 10 is a flowchart of a waveform data production program provided for a first waveform data production method.

After the preparation of the original waveform data, the manipulator operates the panel switches 51 to start the waveform data production program indicated in FIG. 10. The waveform data production program is started in step S100. In step S102, the CPU 71 controls the write circuit 54 to write the desired original waveform data into the waveform memory 53. In the writing of the original waveform data, the write circuit 54 writes the original waveform data input through the input terminal 54*a* or the external interface circuit 76 or the original waveform data stored in the external storage device 77 into the waveform memory 53.

Figure 11A:
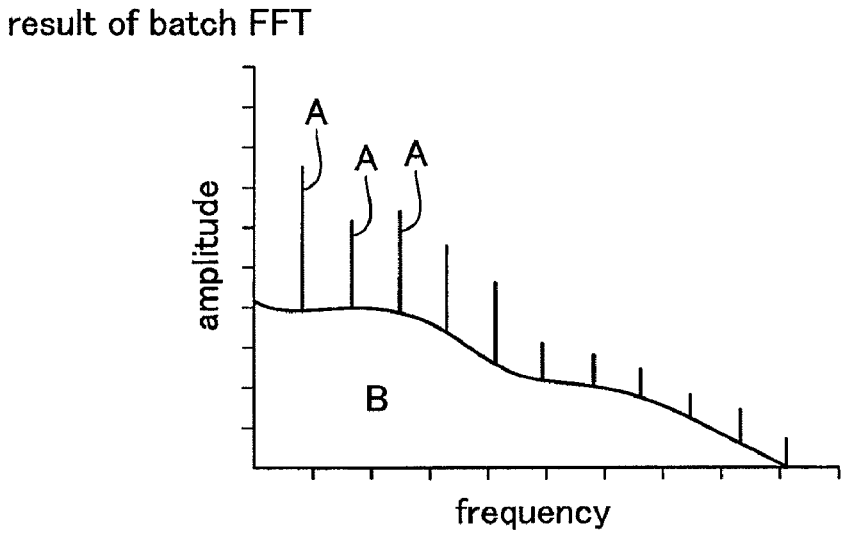
FIG. 11A is a schematic drawing of results of batch FFT process on original waveform data.

After step S102, the CPU 71 proceeds to step S104 to perform fast-Fourier-transform (hereafter, simply referred to as FFT process) on the original waveform data representative of the entire range from the start to the end of a tone emission collectively. The batch FFT process obtains information (spectral components) on frequency, amplitude and phase of the original waveform data representative of the entire range, the information varying according to the passage of time. That is, the FFT process obtains information (spectral components) including time variations in frequency, amplitude and phase. The CPU 71 then proceeds to step S106 to identify a plurality of spectral components (frequency components) corresponding to a plurality of peaks whose amplitude value exceeds a certain value, respectively, by use of the spectral components of the entire range of the original waveform data obtained by the above-described FFT process. In this case, by use of information on frequency and amplitude of the entire range of the original waveform included in the entire information (spectral components) obtained by the FFT process, a spectral distribution regarding the original waveform data over the entire range is derived independently of the passage of time. Then, by use of the derived spectral distribution, the plurality of spectral components (frequency components) corresponding to the plurality of peaks whose amplitude value exceeds the certain value, respectively, are identified. FIG. 11A indicates the derived spectral distribution. Peaks A of the figure correspond to a fundamental frequency and harmonic frequencies (harmonic components) of the musical instrument tone, whereas a lower part B situated under the peaks A corresponds to non-harmonic components including noises whose frequency is not stable. As considered from the spectral distribution of FIG. 11A, the certain value used in order to identify the peaks (spectral components) is preferably a value which exceeds the part B of FIG. 11A and is a function value which gradually decreases with increasing frequencies.

Figure 11B:
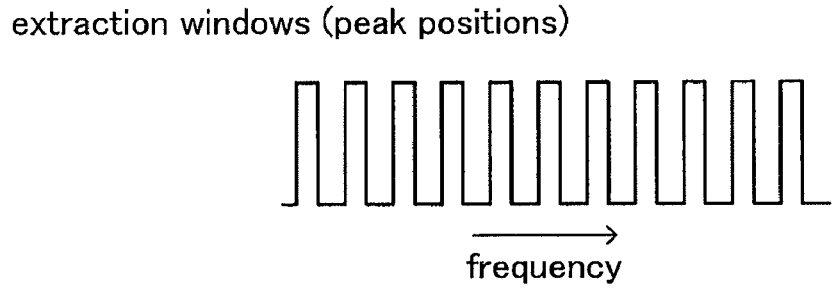
FIG. 11B is a conceptual drawing of extraction windows.
Figure 11C:
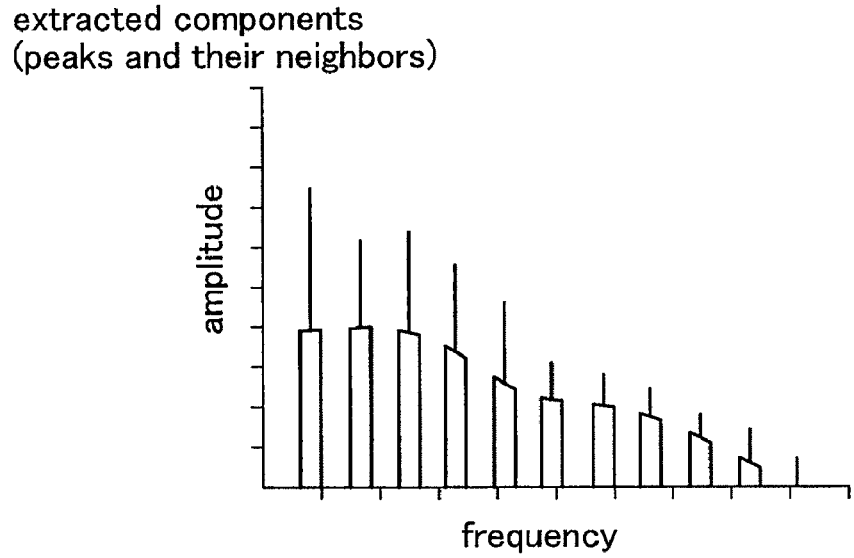
FIG. 11C is a schematic drawing of extracted components.

Then, the CPU 71 proceeds to step S108 to produce a window function representative of a plurality of extraction windows each having a certain small width whose center is a spectral component (frequency component) corresponding to the identified peak. The window function, which is provided for extracting the spectral components and their neighboring spectral components, defines a plurality of frequency ranges each having a certain width on the frequency axis. FIG. 11B indicates the window function.

After step S108, the CPU 71 proceeds to step S110 to extract, from the entire information (spectral components) on the original waveform data obtained in the FFT process of step S104, the spectral components defined by the window function produced in step S108. More specifically, the CPU 71 extracts, from all the spectral components of the original waveform data, the spectral components regarding the frequencies belonging to the frequency ranges defined by the window function. In step S112, the CPU 71 performs inverse fast-Fourier-transform (hereafter, simply referred to as inverse FFT process) on the extracted spectral components to synthesize waveform data representative of a slow decay component waveform. In step S114, the CPU 71 controls the write circuit 54 to write the resultant synthesized waveform data into the waveform memory 53 as the slow decay waveform data.

After step S114, the CPU 71 proceeds to step S116 to sequentially subtract the slow decay waveform data stored in the waveform memory 53 from the original waveform data stored in the waveform memory 53 from the top to the end of the two waveform data sets. The subtracted result is the fast decay waveform data of the present invention obtained by removing the slow decay waveform data from the original waveform data. In step S118, the CPU 71 writes the waveform data which is the subtracted result into the waveform memory 53 as the fast decay waveform data, and then proceeds to step S120 to terminate the waveform data production program. As a result, a pair of slow decay waveform data and fast decay waveform data is stored in the waveform memory 53.

After the pair of slow decay waveform data and fast decay waveform data has been stored in the waveform memory 53, the manipulator prepares original waveform data representative of a waveform of a tone of the same type of musical instrument and the same tone pitch as the previous case (if it is a percussion instrument, the same type of musical instrument) but a different strength from the previous case. Then, the waveform data production program of FIG. 10 is executed again for the original waveform data. As a result, the waveform memory 53 stores another pair of slow decay waveform data and fast decay waveform data representative of the waveform of the tone having the same tone pitch and the same type of musical instrument as the previous case (if it is a percussion instrument, the same type of musical instrument) but having a strength different from the previous case. Repetitions of such processes allow successive storage of pairs of slow decay waveform data and fast decay waveform data representative of waveforms having the same tone pitch of the same type of musical instrument (if it is a percussion instrument, waveforms of the same type of musical instrument) but having different strengths in the waveform memory 53. For instance, pairs of slow decay waveform data and fast decay waveform data corresponding to different levels of the key touch strength VEL and operator touch strength VEL of "127", "80", "48", "16" (or "127", "85", "43", "1") are successively stored in the waveform memory 53. As for electronic musical instruments, in fact, waveform data necessary for synthesis of a musical tone is a plurality of fast decay waveform data sets corresponding to different levels of key touch strength VEL or operator touch strength VEL (e.g., "127", "80", "48", "16" or "127", "85", "43", "1") and a set of slow decay waveform data of the largest key touch strength VEL or operator touch strength VEL (e.g., "127"). Therefore, waveform data other than the necessary data may be deleted from the waveform memory 53. Alternatively, such unnecessary data may not be stored in the waveform memory 53 at the storage processes of steps S122, S126.

After the storage of the waveform set formed of the fast decay waveform data sets and at least one set of slow decay waveform data on the tone pitch of the type of musical instrument in the waveform memory 53, furthermore, waveform sets of different tone pitches of the same type of musical instrument as the previous case are stored in the waveform memory 53 by the same processes as the previous case. After the storage of the waveform sets of all the tone pitches or all the tone pitch ranges in the waveform memory 53, waveform sets of different types of musical instrument are stored in the waveform memory 53 by the same processes as the previous case. By the repetitions of the waveform data production process, as a result, the waveform memory 53 is to store waveform sets representative of decay-type musical instrument tones of different strengths of required tone pitches of desired types of musical instrument.

The first waveform data production method enables the manipulator to create sets of fast decay waveform data and a set of slow decay waveform data on the basis of original waveform data relatively easily in a short time. The first waveform data production method is applicable to production of fast decay waveform data sets and a set of slow decay waveform data on each musical tone of various kinds of musical instruments whose tones decay. However, the first waveform data production method is best suited to production of fast decay waveform data sets and a set of slow decay waveform data of each musical tone of electric pianos of various manufacturers.

b3. Second Waveform Data Production Method

Figure 12:
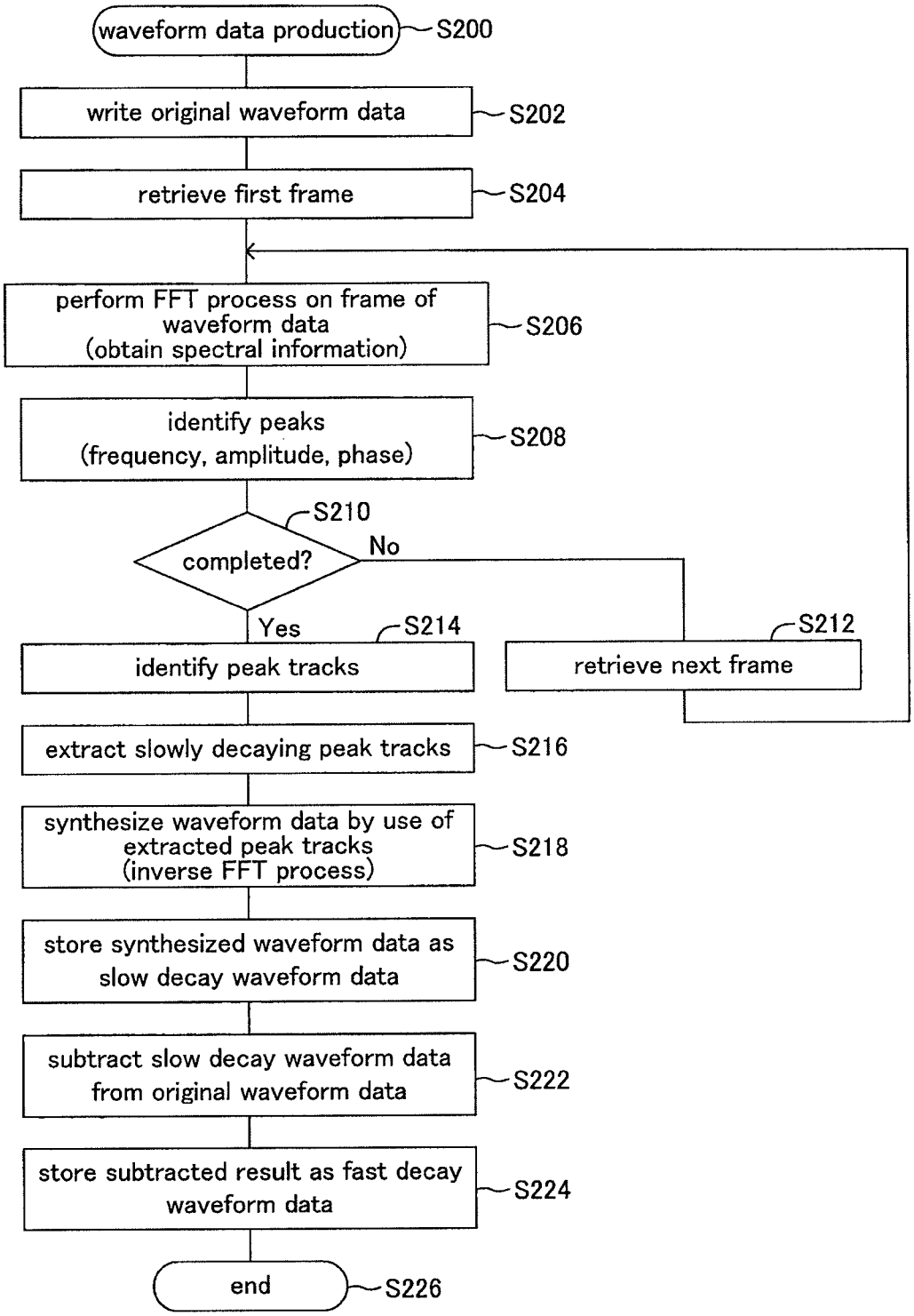
FIG. 12 is a flowchart of a waveform data production program provided for a second waveform data production method.

Next, the second method of producing waveform data will be described. In this method as well, similarly to the case of the first waveform data production method, the manipulator prepares original waveform data of a decay-type musical tone having a desired strength of a desired tone pitch of a desired type of musical instrument (in a case of a percussion tone, original waveform data having a desired strength of a desired type of musical instrument). The manipulator then operates the panel switches 51 to start a waveform data production program indicated in FIG. 12. The waveform data production program is started in step S200. In step S202, as in the case of the first waveform data production method, the CPU 71 controls the write circuit 54 to write the original waveform data into the waveform memory 53.

After the process of step S202, the CPU 71 proceeds to step S204 to provide a time window at the top of the original waveform data to retrieve the first frame of the original waveform data contained in the time window. The width of the time window is on the order of eight times of a cycle of a fundamental frequency component, for example. In step S206, the CPU 71 performs FFT process on the retrieved frame of the original waveform data to obtain spectral information on the frame. The spectral information includes three kinds of information of frequency, amplitude and phase on the frame of original waveform data. The CPU 71 then proceeds to step S208 to perform spectral analysis on the spectral information to identify peaks in the spectral distribution to detect the three kinds of information of frequency, amplitude and phase of the identified peaks. The CPU 71 then proceeds to step S210 to determine whether the end of the original waveform data, that is, the last frame of waveform data has been retrieved. If the last frame of waveform data has not been retrieved yet, the CPU 71 makes a negative determination in step S210 to proceed to step S212 to move the time window to retrieve the following frame of waveform data to return to step S206. The time period required to move the time window is on the order of one-eighth of a cycle of a fundamental frequency component, for example. The CPU 71 then performs the processes of steps S206, S208 to identify peaks of the following frame of original waveform data and to identify the three kinds of information of frequency, amplitude and phase of the peaks. Repetitions of a loop consisting of steps S206 to S212 enable retrieval of the three kinds of information of frequency, amplitude and phase of the peaks of respective frames of the original waveform data over the frames ranging from the top to the end of the original waveform data.

Figure 13A:
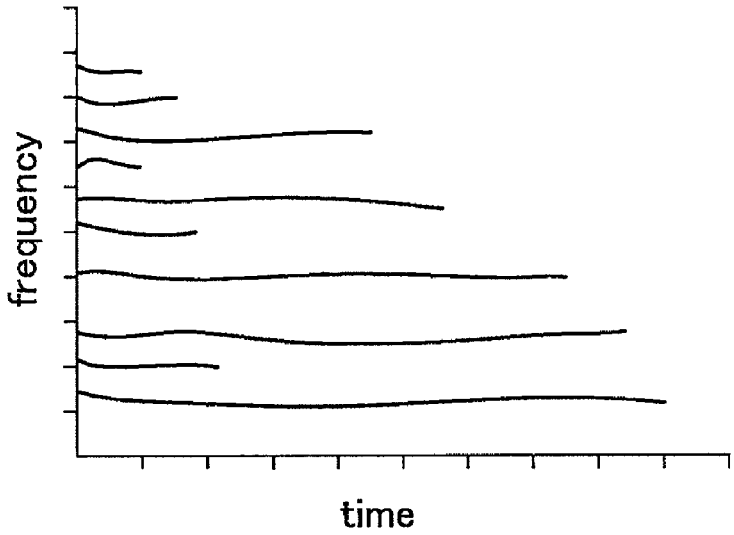
FIG. 13A is a schematic drawing of peak tracks of an original waveform.

If the retrieval of the last frame of the waveform data has been completed, the CPU 71 makes a positive determination in step S210 to proceed to step S214 to identify a plurality of peak tracks. For the identification of peak tracks, the CPU 71 extracts, from a frame, only the peaks whose frequencies, amplitudes and phases are smoothly linked to those of the peaks of its adjacent frame. More specifically, the frequencies, amplitudes and phases of respective peaks of the frame are compared with those of peaks of the adjacent frame to extract only the peaks having the smallest variations in the frequency, amplitude and phase. For the identification of peak tracks, furthermore, the thus extracted peaks of the respective frames ranging from the first to last frames are organized by frequency to connect the extracted peaks frequency by frequency. As a result, noises and non-harmonic components are removed. FIG. 13A schematically indicates the peak tracks of the original waveform.

Figure 13B:
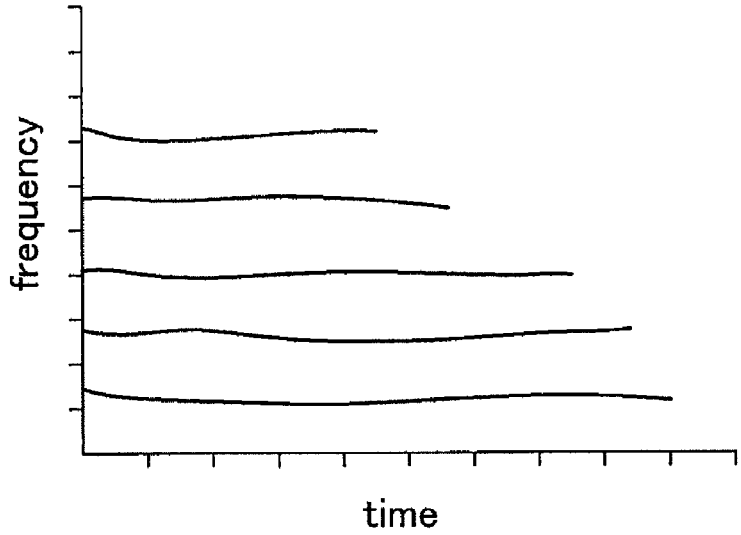
FIG. 13B is a schematic drawing of peak tracks of a slow decay component waveform.

After the process of step S214, the CPU 71 proceeds to step S216 to extract slowly decaying peak tracks from the identified peak tracks. More specifically, the CPU 71 picks only peak tracks that remain to exceed a predetermined time measured from the top of the waveform data and also sustain for a predetermined period of time or more. FIG. 13B indicates a state where only such peak tracks have been extracted from the peak tracks indicated in FIG. 13A. The peak tracks indicated in FIG. 13B are the peak tracks of slow decay components (harmonic components) which decay slowly. For the extraction of the slowly decaying peak tracks, the above-described automatic identification of peak tracks by the computer processing may be replaced with a manipulator's manual extraction. In this manual extraction, the display unit 52 displays the peak tracks shown in FIG. 13A to prompt the manipulator to select and extract the slowly decaying peak tracks by use of the panel switches 51.

Then, the CPU 71 proceeds to step S218 to perform inverse FFT process on the spectral information corresponding to the extracted peak tracks of all the frames ranging from the top to the end of the original waveform data to synthesize the waveform data representative of a slow decay component waveform. In step S220, the CPU 71 controls the write circuit 54 to write the resultant synthesized waveform data into the waveform memory 53 as the slow decay waveform data. The above-described FFT process on each frame, the identification of the peaks, the identification of the peak tracks, the inverse FFT process (sinusoidal wave production process) are well-known arts disclosed, for example, in Japanese Unexamined Patent Publication No. 2000-10565, Japanese Unexamined Patent Publication No. 2000-056774, Japanese Unexamined Patent Publication No. 2001-100763, and Japanese Unexamined Patent Publication No. 2003-263170. Therefore, further detailed descriptions thereof will be omitted. The descriptions of these documents are incorporated in this specification.

Then, the CPU 71 proceeds to step S222 to sequentially subtract the slow decay waveform data stored in the waveform memory 53 from the original waveform data stored in the waveform memory 53 from the top to the end of the two waveform data sets. The subtracted result corresponds to the fast decay waveform data of the present invention obtained by removing the slow decay waveform data from the original waveform data. In step S224, the CPU 71 writes the waveform data which is the subtracted result into the waveform memory 53 as the fast decay waveform data, and then proceeds to step S226 to terminate the waveform data production program. As a result, a pair of slow decay waveform data and fast decay waveform data is stored in the waveform memory 53.

After the pair of slow decay waveform data and fast decay waveform data has been stored in the waveform memory 53, similarly to the case of the first waveform data production method, the waveform data production process is performed on musical instrument tones of different strengths, musical instrument tones having different tone pitches and musical tones of different types of musical instrument to store, in the waveform memory 53, waveform sets formed of groups of slow decay waveform data and fast decay waveform data on decay-type musical tones of various strengths, of required tone pitches and of desired types of musical instruments. In this case as well as the first waveform data production method, furthermore, the waveform memory 53 may keep only sets of fast decay waveform data corresponding to various levels of key touch strength VEL or operator touch strength VEL and a set of slow decay waveform data of the largest key touch strength VEL or operator touch strength VEL as a waveform set, deleting the other waveform data included in the waveform set from the waveform memory 53, or may not even store the other waveform data.

Compared with the first waveform data production method, the second waveform data production method requires complicated processes in order to produce fast decay waveform data and slow decay waveform data due to the identification of the peak tracks, also requiring a longer period of time to produce both the waveform data. Compared with the first waveform data production method, however, the second waveform data production method enables the production of fast decay waveform data and slow decay waveform data with high accuracy. Although the second waveform data production method is also applicable to production of fast decay waveform data sets and a set of slow decay waveform data on each musical tone of various kinds of musical instruments whose tones decay, the second waveform data production method is best suited to production of fast decay waveform data sets and a set of slow decay waveform data of each musical tone of electric pianos of various manufacturers.

The above-described first and second waveform data production methods are suitable for musical instruments whose slow decay waveforms contain a relatively small amount of non-harmonic components and allow existence of distinct spectra, but are not suitable that much for percussion instruments such as tom-tom and timpani which contain noise components in their slow decay waveforms. The following third and fourth waveform data production methods are suitable for the percussion instruments such as tom-tom and timpani.

b4. Third Waveform Data Production Method

Figure 14:
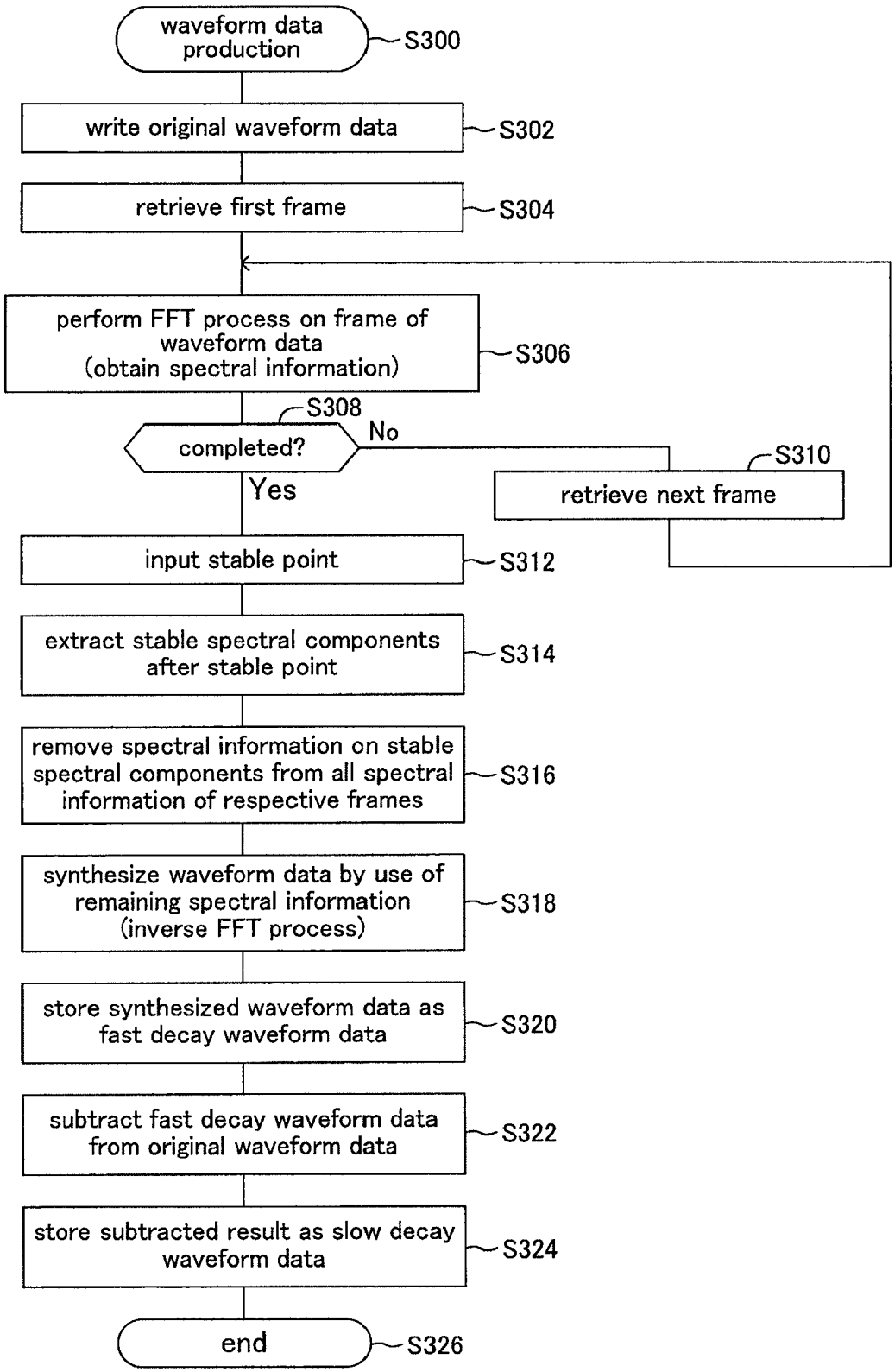
FIG. 14 is a flowchart of a waveform data production program provided for a third waveform data production method.

First, the third method of producing waveform data will be described. In this method as well, similarly to the cases of the first and second waveform data production methods, the manipulator prepares original waveform data of a decay-type musical tone having a desired strength of a desired tone pitch of a desired type of musical instrument (in a case of a percussion tone, original waveform data of a desired strength of a desired type of musical instrument). The manipulator then operates the panel switches 51 to start a waveform data production program indicated in FIG. 14. The waveform data production program is started in step S300. In step S302, as in the case of the first and second waveform data production methods, the CPU 71 controls the write circuit 54 to write the original waveform data into the waveform memory 53.

After the process of step S302, the CPU 71 proceeds to step S304 to provide a time window at the top of the original waveform data to retrieve the first frame of the original waveform data contained in the time window. The width of the time window is also on the order of eight times of a cycle of a fundamental frequency component, for example. In step S306, the CPU 71 performs FFT process on the retrieved frame of the original waveform data to obtain spectral information on the frame. The spectral information also includes three kinds of information of frequency, amplitude and phase on the frame of original waveform data. The CPU 71 then proceeds to step S308 to determine whether the end of the original waveform data, that is, the last frame of waveform data has been retrieved. If the last frame of waveform data has not been retrieved yet, the CPU 71 makes a negative determination in step S308 to proceed to step S310 to move the time window to retrieve the following frame of waveform data to return to step S306. The time period required to move the time window is also on the order of one-eighth of a cycle of a fundamental frequency component, for example. Repetitions of a loop consisting of steps S306 to S310 enable retrieval of the three kinds of spectral information of respective frames of the original waveform data over the frames ranging from the top to the end of the original waveform data.

Figure 15A:
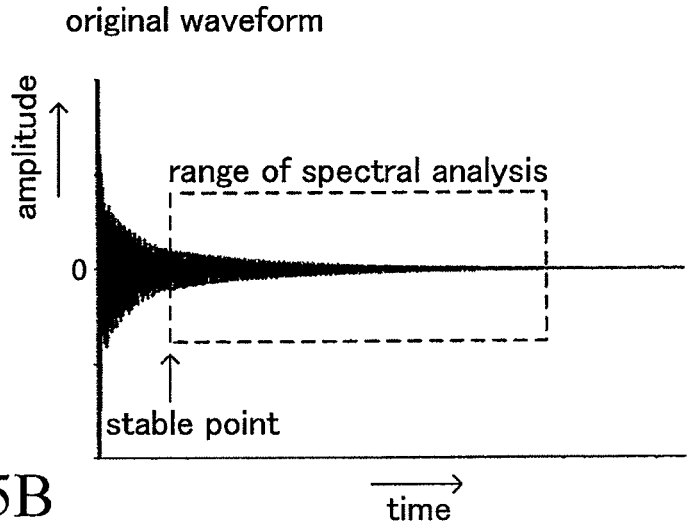
FIG. 15A is a schematic drawing of an original waveform.

If the retrieval of the last frame of waveform data has been completed, the CPU 71 makes a positive determination in step S308 to proceed to step S312 to prompt the manipulator to input a stable point. The stable point is a point where a fast decay component waveform which decays fast finishes decaying, so that only a slow decay component waveform which decays slowly remains. That is, the stable point is a time point where only the harmonic components remain, so that the waveform of the musical tone becomes stable without fluctuations with time. The stable point may be a time point situated behind the time point where the musical tone waveform becomes stable in order to ensure the stability of the musical tone waveform. For the input of the stable point, an original waveform (FIG. 15A) represented by use of the original waveform data or the like is displayed on the display unit 52 to prompt the manipulator to input the stable point. Watching the original waveform or the like displayed on the display unit 52, the manipulator manipulates the panel switches 51 to input a time point corresponding to the stable point.

Instead of the above-described input of the stable point by the manipulator, the embodiment may be modified such that the CPU 71 automatically determines a stable point by a program process. In this case, a certain time period necessary for stabilization of time-varying frequencies may be previously estimated by various experiments and the like to store the certain time period along with the program, so that a time point corresponding to the certain time period is utilized as the stable point. Alternatively, the embodiment may be modified such that the manipulator designates a value of amplitude of the original waveform used for the designation of the stable point, or that the amplitude value of the original waveform is stored so that a time point where the amplitude of the original waveform represented by the original waveform data stored in the waveform memory 53 decays to be the designated or stored amplitude value may be determined as the stable point.

After the process of step S312, the CPU 71 proceeds to step S314 to analyze spectral distributions of a plurality of frames situated after the above-provided stable point (a range enclosed by dashed lines in FIG. 15A), respectively, to extract spectral components contained in the respective frames successively as stable spectral components (i.e., frequency components). The spectral components contained successively in the respective frames are those whose ratio to all the spectral components of each frame is a predetermined value or more, with the ratio of the components to all the components of each frame being successively kept almost constant over the frames without significant variations in the ratio. In other words, such spectral components are contained averagely (almost equally) in every frame in succession after the stable point. For the extraction of the stable spectral components, spectral components of each frame whose absolute amount decreases with the passage of time are increased by a scaling process to convert the spectral components to those having a constant amplitude value which is large to some extent, whereas the spectral component distributions of the original waveform of all the frames situated after the stable point are examined to extract the stable spectral components contained averagely (almost equally) in the respective frames. However, the stable spectral components have slight fluctuations in frequency. Therefore, the spectral components contained averagely (almost equally) in the respective frames successively can include slightly varying spectral components (frequency), so that the stable spectral components have slight variations. The stable spectral components are harmonic components (fundamental wave components and harmonic overtone components) of original waveform signals.

In step S316, the CPU 71 removes spectral information on the stable spectral components from all the spectral information contained in the respective frames ranging from the top to the end of the original waveform data. More specifically, the CPU 71 removes, from the spectral information of each frame obtained by the process of step S306, spectral information regarding frequencies belonging to a frequency range defined by the stable spectral components. Over all the frames, as a result, the spectral information on the stable components which decay slowly (slow decay components) is removed, so that only the spectral information on fast decay components which decay fast remains. To such a removal of spectral information, a well-known noise canceling art such as the one disclosed in Japanese Unexamined Patent Publication No. H9-34497 is applicable. The description of this document is incorporated in this specification. In this embodiment, however, what are removed are not noise components but rather frequency components. After the process of step S316, the CPU 71 proceeds to step S318 to perform inverse FFT process on the remaining spectral information of all the frames to synthesize waveform data representative of a fast decay component waveform. In step S320, the CPU 71 controls the write circuit 54 to write the synthesized waveform data into the waveform memory 53 as the fast decay waveform data.

Figure 15B:
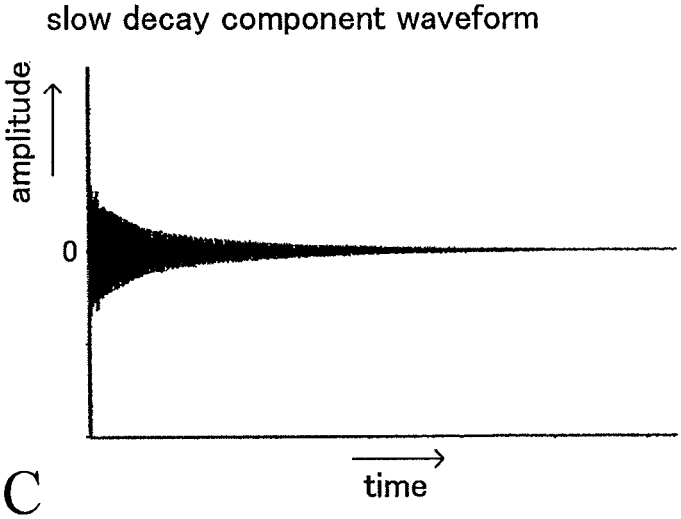
FIG. 15B is a schematic drawing of a slow decay component waveform.
Figure 15C:
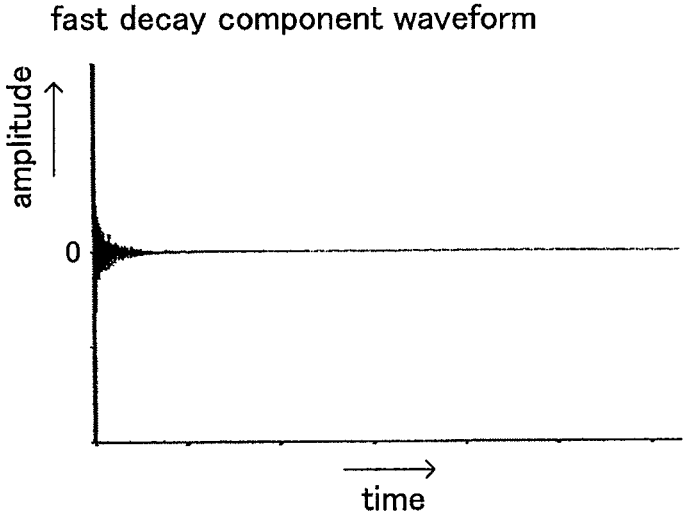
FIG. 15C is a schematic drawing of a fast decay component waveform.

Then, the CPU 71 proceeds to step S322 to sequentially subtract the fast decay waveform data stored in the waveform memory 53 from the original waveform data stored in the waveform memory 53 from the top to the end of the two waveform data sets. The subtracted result corresponds to the slow decay waveform data of the present invention obtained by removing the fast decay waveform data from the original waveform data. In step S324, the CPU 71 writes the waveform data which is the subtracted result into the waveform memory 53 as the slow decay waveform data, and then proceeds to step S326 to terminate the waveform data production program. As a result, a pair of slow decay waveform data and fast decay waveform data is stored in the waveform memory 53. FIG. 15B schematically indicates a slow decay component waveform represented by slow decay waveform data, whereas FIG. 15C schematically indicates a fast decay component waveform represented by fast decay waveform data.

After the pair of slow decay waveform data and fast decay waveform data has been stored in the waveform memory 53, similarly to the cases of the first and second waveform data production methods, the waveform data production process is performed on musical instrument tones of different strengths, musical instrument tones having different tone pitches and musical tones of different types of musical instrument to store, in the waveform memory 53, waveform sets each formed of groups of slow decay waveform data and fast decay waveform data on decay-type musical tones of various strengths, of required tone pitches and of desired types of musical instruments. In this case as well as the first and second waveform data production methods, furthermore, the waveform memory 53 may keep only sets of fast decay waveform data corresponding to key touch strengths VEL or operator touch strengths VEL and a set of slow decay waveform data of the largest key touch strength VEL or operator touch strength VEL as a waveform set, deleting the other waveform data included in the waveform set from the waveform memory 53, or may not even store the other waveform data.

Compared with the second waveform data production method, the third waveform data production method is easy and does not require a long period of time in order to produce both the waveform data. Although the third waveform data production method is also applicable to production of fast decay waveform data sets and a set of slow decay waveform data on each musical tone of various kinds of musical instruments whose tones decay, the third waveform data production method is best suited to production of fast decay waveform data sets and a set of slow decay waveform data on each musical tone of percussion instruments which require relatively longer periods of time to decay such as tom-tom and timpani. When such percussion instruments are struck, noise waves occur on their surfaces on which players strike. Later on, however, waves other than a standing wave decay faster than the standing waves. That is, the standing wave corresponds to the slow decay component waveform.

b5. Fourth Waveform Data Production Method

Figure 16:
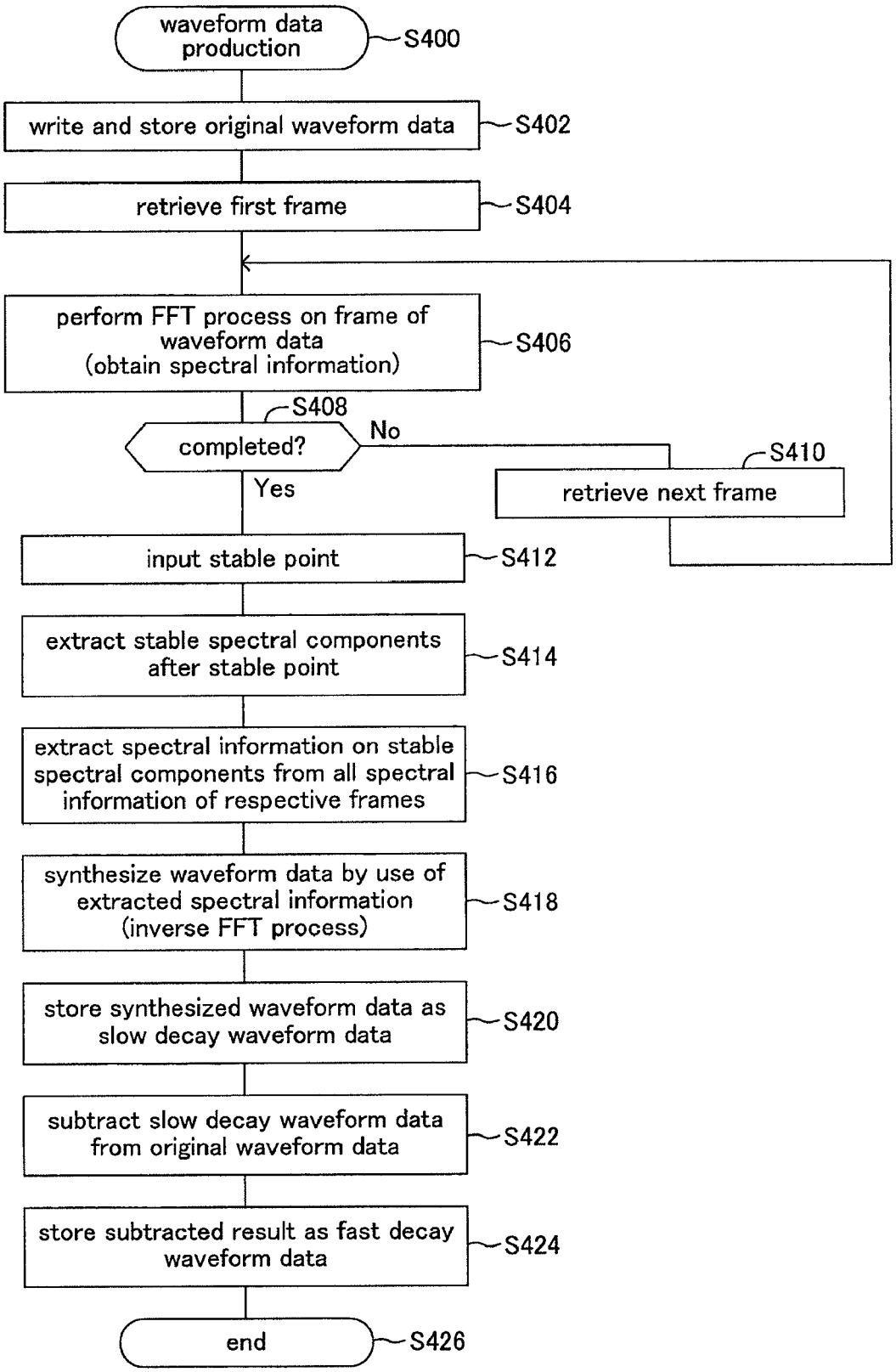
FIG. 16 is a flowchart of a waveform data production program provided for a fourth waveform data production method.

Next, the fourth method of producing waveform data will be described. In this case as well, similarly to the cases of the first to third waveform data production methods, the manipulator prepares original waveform data of a decay-type musical tone of a desired strength of a desired tone pitch of a desired type of musical instrument (in a case of a percussion tone, original waveform data of a desired strength of a desired type of musical instrument). The manipulator then operates the panel switches 51 to start a waveform data production program indicated in FIG. 16. The waveform data production program is started in step S400. By processes of steps S402 to S414 which are similar to those of steps S302 to S314 of FIG. 14, the CPU 71 retrieves spectral information on respective frames of the original waveform data, respectively, over the frames ranging from the top to the end of the original waveform data, also analyzing spectra of respective frames situated after the stable point (the range enclosed by the dashed lines in FIG. 15A) to extract stable spectral components (i.e., frequency components) contained averagely in the respective frames.

After the processes of steps S402 to S414, the CPU 71 proceeds to step S416 to extract spectral information on the stable spectral components from all the spectral information contained in the respective frames ranging from the top to the end of the original waveform data. More specifically, the CPU 71 extracts, from the spectral information of each frame, spectral information regarding frequencies belonging to a frequency range defined by the stable spectral components. Oppositely to the third waveform data production method, as a result, over all the frames, the spectral information on the fast decay components which decay fast is removed, so that only the spectral information on the stable components (slow decay components) which decay slowly is extracted. Then, the CPU 71 proceeds to step S418 to perform inverse FFT process on the extracted spectral information of all the frames to synthesize waveform data representative of a slow decay component waveform. In step S420, the CPU 71 controls the write circuit 54 to write the synthesized waveform data into the waveform memory 53 as the slow decay waveform data.

After the process of step S420, the CPU 71 proceeds to step S422 to sequentially subtract the slow decay waveform data stored in the waveform memory 53 from the original waveform data stored in the waveform memory 53 from the top to the end of the two waveform data sets. The subtracted result corresponds to the fast decay waveform data of the present invention obtained by removing the slow decay waveform data from the original waveform data. In step S424, the CPU 71 writes the waveform data which is the subtracted result into the waveform memory 53 as the fast decay waveform data, and then proceeds to step S426 to terminate the waveform data production program. Similarly to the third waveform data production method, as a result, a pair of slow decay waveform data and fast decay waveform data is stored in the waveform memory 53.

After the pair of slow decay waveform data and fast decay waveform data has been stored in the waveform memory 53, similarly to the cases of the first to third waveform data production methods, the waveform data production process is performed on musical instrument tones of different strengths, musical instrument tones having different tone pitches and musical tones of different types of musical instrument to store, in the waveform memory 53, waveform sets formed of groups of slow decay waveform data and fast decay waveform data on decay-type musical tones of various strengths, of required tone pitches and of desired types of musical instruments. In this case as well as the first to third waveform data production methods, furthermore, the waveform memory 53 may keep only sets of fast decay waveform data corresponding to key touch strengths VEL or operator touch strengths VEL and a set of slow decay waveform data of the largest key touch strength VEL or operator touch strength VEL as a waveform set, deleting the other waveform data included in the waveform set from the waveform memory 53, or may not even store the other waveform data.

Oppositely to the third waveform data production method, the fourth waveform data production method enables the production of slow decay waveform data by inverse FFT process, also enabling the production of fast decay waveform data by subtraction of slow decay waveform data from original waveform data. Similarly to the third waveform data production method, as a result, the fourth waveform data production method enables the production of both the waveform data with facility and without requiring a long period of time. Although the fourth waveform data production method is also applicable to production of fast decay waveform data sets and a set of slow decay waveform data on each musical tone of various kinds of musical instruments whose tones decay, the fourth waveform data production method is best suited to production of fast decay waveform data sets and a set of slow decay waveform data on each musical tone of percussion instruments which require relatively longer periods of time to decay such as tom-tom and timpani.

What is claimed is:

1. A musical tone signal generating apparatus comprising:

a waveform memory storing fast decay waveform data of a plurality of fast decay waveforms, extracted from a plurality of waveforms of a musical instrument performed with various levels of strength, and slow decay waveform data of a slow decay waveform, extracted from a waveform of the musical instrument performed with a high level of strength;

a first read-out section for selecting, in response to a generation start command which instructs the apparatus to newly generate a musical tone signal and includes strength information representative of level of strength of the musical tone signal, fast decay waveform data of at least a fast decay waveform from among the fast decay waveform data stored in the waveform memory, according to the strength information, and reading out the selected fast decay waveform data from a top address of the selected fast decay waveform data;

a second read-out section for determining, in response to the generation start command, a read start address of the slow decay waveform data based on the strength information in the generation start command and reading out the slow decay waveform data stored in the waveform memory from the determined start address of the slow decay waveform data, the read start address being determined further away from a top address of the slow decay waveform data as the strength represented by the strength information decreases; and a mixing section for mixing the fast decay waveform data read out by the first read-out section and the slow decay waveform data read out by the second read-out section, and outputting the mixed waveform data.

2. A musical tone signal generating apparatus according to claim 1, wherein the mixing section controls tone volume of the fast decay waveform data read by the first read-out section in accordance with the strength information, such that the tone volume of the fast decay waveform data increases as the strength represented by the strength information increases, before mixing the fast decay waveform data with the slow decay waveform data read by the second read-out section.

3. A musical tone signal generating apparatus according to claim 1, wherein the first read-out section selects, in response to the generation start command, fast decay waveform data of a first fast decay waveform and a second fast decay waveform, having two adjacent strengths between which the strength represented by the strength information falls into, from among the fast decay waveform data stored in the waveform memory, and reads out fast decay waveform data of the first fast decay waveform and fast decay waveform data of the second fast decay waveform in parallel from their respective top addresses;

the mixing section has a designating section for designating, in accordance with the strength information and the two adjacent strengths, a mixing ratio; and the mixing section controls tone volume of the fast decay waveform data of the first fast decay waveform and tone volume of the fast decay waveform data of the second fast decay waveform, according to the designated mixing ratio, and then mixes the fast waveform data of the first fast decay waveform, the fast decay waveform data of the second fast waveform and the slow decay waveform data read by the second read-out section to output the mixed waveform data.

4. A musical tone signal generating apparatus according to claim 3, wherein the mixing section controls tone volume of the first fast decay waveform data and the second fast decay waveform data, such that tone volume of a waveform data obtained by mixing the first decay waveform data and the second fast decay waveform data increases as the strength represented by the strength information increases, in accordance with the strength information before mixing the first and second fast decay waveform data read by the first read-out section with the slow decay waveform data read by the second read-out section.

5. A musical tone signal generating apparatus comprising:

a waveform memory storing a plurality of waveform data sets corresponding to a plurality of pitch ranges, each of the waveform data sets including fast decay waveform data of a plurality of fast decay waveforms, extracted from a plurality of waveforms of a musical instrument performed at a pitch and with various levels of strength, and slow decay waveform data of a slow decay waveform, extracted from a waveform of the musical instrument performed at the pitch and with a high level of strength;

a selecting section for selecting, in response to a generation start command which instructs the apparatus to newly generate a musical tone signal and includes pitch information representative of the musical tone signal and strength information representative of strength of the musical tone signal, one of the waveform data sets stored in the waveform memory according to the pitch information;

a first read-out section for selecting, in response to the generation start command, fast decay waveform data of at least a fast decay waveform from among the fast decay waveform data in the selected waveform data set stored in the waveform memory, according to the strength information, and reading out the selected fast decay waveform data from a top address of the selected fast decay waveform data;

a second read-out section for determining, in response to the generation start command, a read start address of the slow decay waveform data in the selected waveform data set based on the strength information in the generation start command and reading out the slow decay waveform data stored in the waveform memory from the determined start address of the slow decay waveform data, the read start address being determined further away from a top address of the slow decay waveform data as the strength represented by the strength information decreases; and a mixing section for mixing the fast decay waveform data read out by the first read-out section and the slow decay waveform data read out by the second read-out section, and outputting the mixed waveform data.

6. A musical tone signal generating apparatus according to claim 5, wherein the mixing section controls tone volume of the fast decay waveform data read by the first read-out section in accordance with the strength information, such that the tone volume of the fast decay waveform data increases as the strength represented by the strength information increases, before mixing the fast decay waveform data with the slow decay waveform data read by the second read-out section.

* * * * *